US012344504B2

(12) United States Patent
Hayashi

(10) Patent No.: US 12,344,504 B2
(45) Date of Patent: Jul. 1, 2025

(54) IMAGE FORMING APPARATUS

(71) Applicant: CANON KABUSHIKI KAISHA, Tokyo (JP)

(72) Inventor: Hideki Hayashi, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 416 days.

(21) Appl. No.: 18/058,188

(22) Filed: Nov. 22, 2022

(65) Prior Publication Data

US 2023/0166930 A1 Jun. 1, 2023

(30) Foreign Application Priority Data

Nov. 30, 2021 (JP) ..... 2021-193705

(51) Int. Cl.

| | |
|---|---|
| ***B65H 85/00*** | (2006.01) |
| ***B65H 7/10*** | (2006.01) |
| ***B65H 9/00*** | (2006.01) |
| ***B65H 9/10*** | (2006.01) |

(52) U.S. Cl.

CPC ..... *B65H 85/00* (2013.01); *B65H 7/10* (2013.01); *B65H 9/002* (2013.01); *B65H 9/006* (2013.01); *B65H 9/103* (2013.01); *B65H 2404/1424* (2013.01); *B65H 2511/11* (2013.01); *B65H 2801/06* (2013.01)

(58) Field of Classification Search

CPC ..... B65H 7/10; B65H 9/002; B65H 9/004; B65H 9/006; B65H 9/103; B65H 9/106; B65H 85/00; B65H 2404/142; B65H 2404/1422; B65H 2404/1424; B65H 2404/152; B65H 2404/1523; B65H 2511/11; B65H 2801/06

See application file for complete search history.

(56) References Cited

U.S. PATENT DOCUMENTS

2015/0098741 A1* 4/2015 Endo ..... G03G 15/6529 271/3.2
2021/0024318 A1* 1/2021 Haruna ..... B65H 33/08
2021/0373477 A1* 12/2021 Yoshida ..... G03G 15/235

FOREIGN PATENT DOCUMENTS

JP H06250464 A 9/1994
JP 2009143643 A 7/2009

* cited by examiner

*Primary Examiner* — Prasad V Gokhale
(74) *Attorney, Agent, or Firm* — Canon U.S.A., Inc. IP Division

(57) ABSTRACT

An image forming apparatus includes an image forming unit, a reversing roller pair, a moving unit, and an obtaining unit. The image forming unit forms an image on a sheet. The reversing roller pair nips the sheet having the image, rotates in a first direction, and then rotate in a second direction and conveys the sheet. The moving unit moves the reversing roller pair. The obtaining unit obtains the sheet length. If a first sheet having a first length is reversed and conveyed, the moving unit moves the reversing roller pair conveying the first sheet in the width direction by a first moving amount. If a second sheet having a second length greater than the first length is reversed and conveyed, the moving unit moves the reversing roller pair conveying the second sheet in the width direction by a second moving amount smaller than the first moving amount.

13 Claims, 14 Drawing Sheets

IMAGE FORMING APPARATUS

BACKGROUND

Field

The present disclosure relates to an image forming apparatus that forms an image on a sheet.

Description of the Related Art

In general, a sheet being conveyed in an image forming apparatus, such as a copying machine, can deviate laterally in a width direction orthogonal to a sheet conveyance direction. If an image is formed on the laterally deviated sheet, the image can be printed off the center position in the width direction of the sheet.

As discussed in Japanese Patent Application Laid-Open No. 2009-143643, a shift mechanism for detecting the position of an end of a sheet in the width direction and correcting a lateral deviation (positional deviation) of the sheet before an image is formed on the sheet has therefore been known.

As discussed in Japanese Patent Application Laid-Open No. H06-250464, some known image forming apparatuses include a reversing mechanism for switching back a sheet and conveying the sheet to form an image on a sheet surface opposite to where an image has been formed.

If a reversing shift mechanism including both a shift mechanism and a reversing mechanism shifts a skewed sheet long in the sheet conveyance direction widthwise, the apparatus may be increased in size because a large space in the width direction is to be provided.

SUMMARY

According to an aspect of the present disclosure, an image forming apparatus includes an image forming unit configured to form an image on a sheet, a reversing roller pair configured to nip the sheet onto which the image forming unit forms the image and to rotate in a first direction, and then rotate in a second direction opposite to the first direction to reverse and convey the sheet, a moving unit configured to move the reversing roller pair in a width direction of the sheet orthogonal to a conveyance direction of the sheet with the sheet nipped by the reversing roller pair, an obtaining unit configured to obtain information about a length of the sheet in the conveyance direction, and a control unit configured to control the moving unit based on the information about the length of the sheet obtained by the obtaining unit, wherein, in a case where a first sheet of which the length in the conveyance direction is a first length is reversed and conveyed, the control unit controls the moving unit to move the reversing roller pair conveying the first sheet in the width direction by a first moving amount, and wherein, in a case where a second sheet of which the length in the conveyance direction is a second length greater than the first length is reversed and conveyed, the control unit controls the moving unit to move the reversing roller pair conveying the second sheet in the width direction by a second moving amount smaller than the first moving amount.

Further features of the present disclosure will become apparent from the following description of exemplary embodiments with reference to the attached drawings.

DESCRIPTION OF THE EMBODIMENTS

[Image Forming Apparatus]

Figure 1:
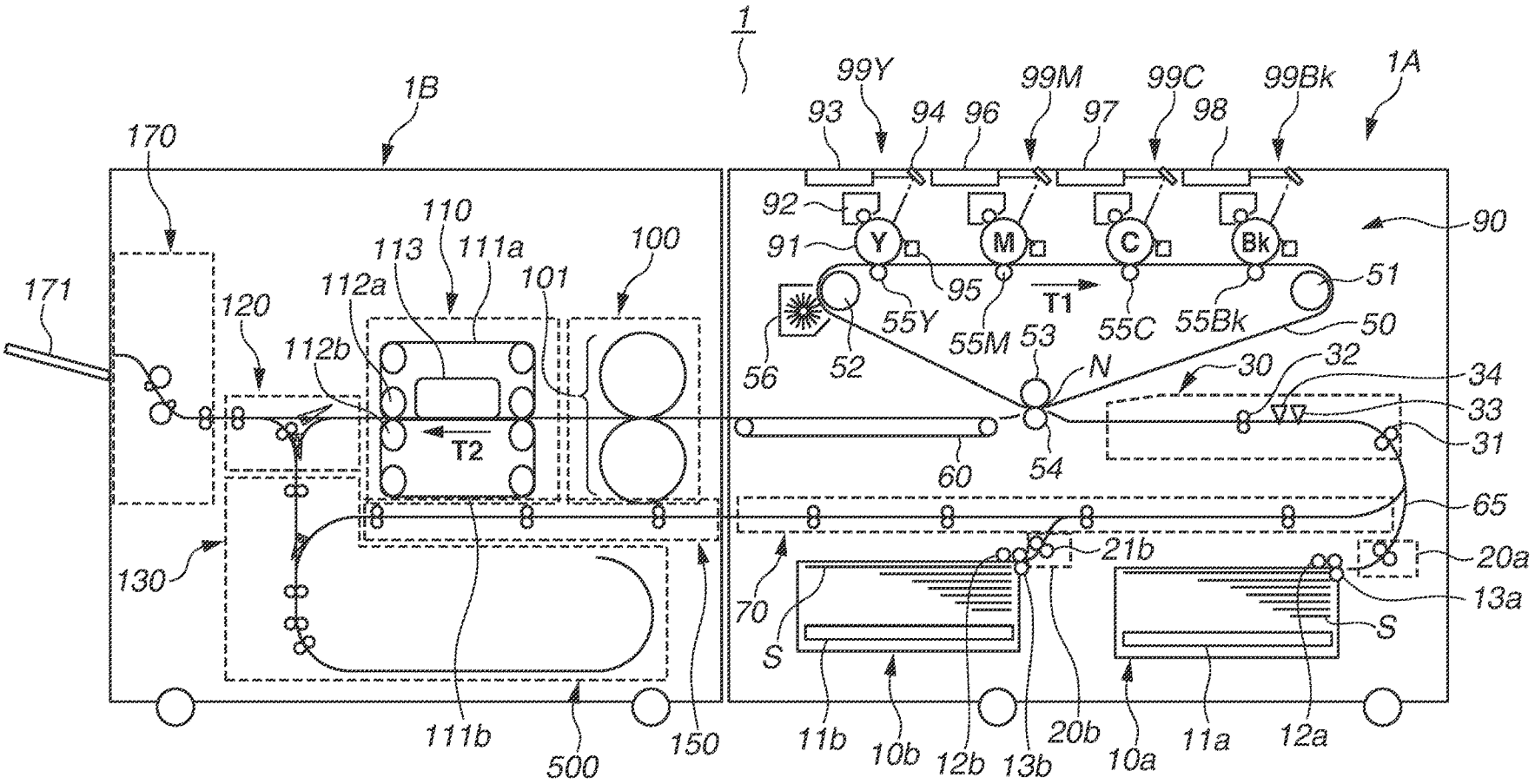
FIG. 1 is an overall schematic diagram illustrating a printer (image forming apparatus) according to a first exemplary embodiment.

A first exemplary embodiment of the present disclosure will initially be described. An image forming apparatus 1 according to the present exemplary embodiment is an electrophotographic full-color laser beam printer. As illustrated in FIG. 1, the image forming apparatus 1 includes a housing 1A serving as a first housing including units for sheet feeding and image formation, and a housing 1B serving as a second housing including units for sheet fixing and cooling. The housing 1B is connected to the housing 1A.

The housing 1A includes feed units 10*a* and 10*b*, drawing units 20*a* and 20*b*, a registration unit 30, an image forming unit 90, and a first two-sided conveyance unit 70. The housing 1B includes a fixing unit 100, a cooling unit 110, a branching conveyance unit 120, a reversing conveyance unit 130, a second two-sided conveyance unit 150, and a decurling unit 170.

The image forming unit 90 includes four process cartridges 99Y, 99M, 99C, and 99Bk for forming yellow (Y), magenta (M), cyan (C), and black (K), four color toner images, respectively, and exposure devices 93, 96, 97, and 98. The four process cartridges 99Y, 99M, 99C, and 99Bk have the same configuration except that images of different colors are formed. A configuration of and an image forming process by only the process cartridge 99Y will therefore be described, and a description of the process cartridges 99M, 99C, and 99Bk will be omitted.

The process cartridge 99Y includes a photosensitive drum 91, a charging roller, a developing device 92, and a cleaner 95. The photosensitive drum 91 is formed by applying an organic photoconductive layer to the outer periphery of an aluminum cylinder, and is rotated by a drive motor. The image forming unit 90 includes an intermediate transfer belt 50 that is rotated in the direction of the arrow T1 by a drive roller 52. The intermediate transfer belt 50 is wound across a tension roller 51, the drive roller 52, and a secondary transfer inner roller 53. Primary transfer rollers 55Y, 55M, 55C, and 55Bk are located inside the intermediate transfer belt 50. A secondary transfer outer roller 54 is located outside the intermediate transfer belt 50, opposite the secondary transfer inner roller 53.

The feed unit 10*a* includes a lift plate 11*a* that is lifted up and down with sheets S stacked thereon, a pickup roller 12*a* that feeds sheets S stacked on the lift plate 11*a*, and a separation roller pair 13*a* that separates the feed sheets S one by one. Similarly, the feed unit 10*b* includes a lift plate 11*b* that is lifted up and down with sheets S stacked thereon, a pickup roller 12*b* that feeds sheets S stacked on the lift plate 11*b*, and a separation roller pair 13*b* that separates the feed sheets S one by one.

The registration unit 30 includes a preregistration roller pair 31 that conveys a sheet S, and a registration roller pair 32 serving as a first moving unit and a first skew correction unit that correct sheet skew. The registration unit 30 further includes a registration sensor 33 that detects the position of the sheet S in a conveyance direction, and a contact image sensor (CIS) 34 serving as a first detection unit that detects the position of the sheet S in a width direction intersecting the conveyance direction. The fixing unit 100 includes a fixing roller pair 101 that can heat the sheet S.

The cooling unit 110 includes an upper cooling belt 111*a* that is rotated in the direction of the arrow T2 by an upper cooling drive roller 112*a*. The cooling unit 110 further includes a lower cooling belt 111*b* that is rotated in the direction of the arrow T2 by a lower cooling drive roller 112*b*, and a heat sink 113 that cools the sheet S.

Next, an image forming operation to be performed by the image forming apparatus 1 thus configured will be described. An image signal is input to the exposure device 93 from a personal computer outside the image forming apparatus 1, and the exposure device 93 irradiates the photosensitive drum 91 of the process cartridge 99Y with laser light corresponding to the image signal.

The surface of the photosensitive drum 91 here is uniformly charged to a predetermined polarity and potential in advance by the charging roller. The irradiation with the laser light from the exposure device 93 via a mirror 94 forms an electrostatic latent image on the surface of the photosensitive drum 91. The electrostatic latent image formed on the photosensitive drum 91 is developed by the developing device 92, so that a Y toner image is formed on the photosensitive drum 91.

Similarly, the photosensitive drums of the respective process cartridges 99M, 99C, and 99Bk are irradiated with laser light from the exposure devices 96, 97, and 98, so that M, C, and K toner images are formed on the process cartridges 99M, 99C, and 99Bk. The color toner images formed on the respective photosensitive drums 91 are transferred to the intermediate transfer belt 50 by the primary transfer rollers 55Y, 55M, 55C, and 55Bk. The resulting full-color toner image is conveyed to a secondary transfer nip N of the secondary transfer inner roller 53 and the secondary transfer outer roller 54 by the intermediate transfer belt 50 rotated by the drive roller 52. Toner remaining on the photosensitive drum 91 is collected by the cleaner 95. The image forming processes of the respective colors are performed at the timing of superposition on the upstream toner image(s) primarily transferred to the intermediate transfer belt 50.

In parallel with the image forming processes, a sheet S is fed from either one of the feed units 10*a* and 10*b*, and the sheet S is conveyed to the registration unit 30 by the corresponding one of the drawing units 20*a* and 20*b*. In the registration unit 30, the preregistration roller pair 31 abuts the leading edge of the sheet S against the nip portion of the registration roller pair 32 at rest. This corrects the skew of the sheet S, and the sheet S is conveyed to the secondary transfer nip N serving as an image forming portion at predetermined conveyance timing. The full-color toner image on the intermediate transfer belt 50 is transferred to a first sheet surface (front) of the sheet S by a secondary transfer bias applied to the secondary transfer outer roller 54. Residual toner remaining on the intermediate transfer belt 50 is collected by a belt cleaner 56.

The sheet S onto which the toner image is transferred is conveyed to the fixing unit 100 by a pre-fixing conveyance unit 60. The sheet S is then guided to the nip portion of the fixing roller pair 101, and predetermined heat and pressure are applied to melt and make adhere (fix) the toner thereonto. The sheet S past the fixing unit 100 is sandwiched between the upper and lower cooling belts 111*a* and 111*b* that are endless belts, and conveyed in the cooling unit 110. The heat of the sheet S transfers to the heat sink 113 via the upper cooling belt 111*a*, so that the sheet S is cooled.

The branching conveyance unit 120 then makes a path selection whether to convey the sheet S to the decurling unit 170 or the reversing conveyance unit 130. The sheet S may be once conveyed to the reversing conveyance unit 130, reversed so that the first sheet surface on which the image is formed at the secondary transfer nip N faces down, and then conveyed to the decurling unit 170.

In the case of forming an image on only one side of the sheet S, the sheet S is conveyed from the branching conveyance unit 120 to the decurling unit 170, and the sheet S is decurled using small-diameter hard rollers and large-diameter soft rollers. The sheet S past the decurling unit 170 is then discharged to a discharge tray 171.

In the case of forming images on both sides of the sheet S, the sheet S is conveyed to the reversing conveyance unit 130 by the branching conveyance unit 120, and switched back in the reversing conveyance unit 130. The sheet S switched back is conveyed from the reversing conveyance unit 130 to the second two-sided conveyance unit 150 and the first two-sided conveyance unit 70, and guided to the registration unit 30. An image is then formed on a second sheet surface (back) of the sheet S at the secondary transfer nip N, and the sheet S is discharged to the discharge tray 171 via the branching conveyance unit 120 and the decurling unit 170.

The branching conveyance unit 120, the reversing conveyance unit 130, the second two-sided conveyance unit 150, and the first two-sided conveyance unit 70 constitute a reconveyance unit 500 that reverses the sheet S with a first side of which an image has been formed front and back and conveys the sheet S to the secondary transfer nip N again.

The image forming apparatus 1 according to the present exemplary embodiment will hereinafter be described on the assumption that a center-reference sheet conveyance method is used, where a sheet S is conveyed so that the center of the sheet S in the width direction orthogonal to the conveyance direction agrees with the center of a conveyance path 65 in the width direction, for example.

[Registration Unit]

Figure 2:
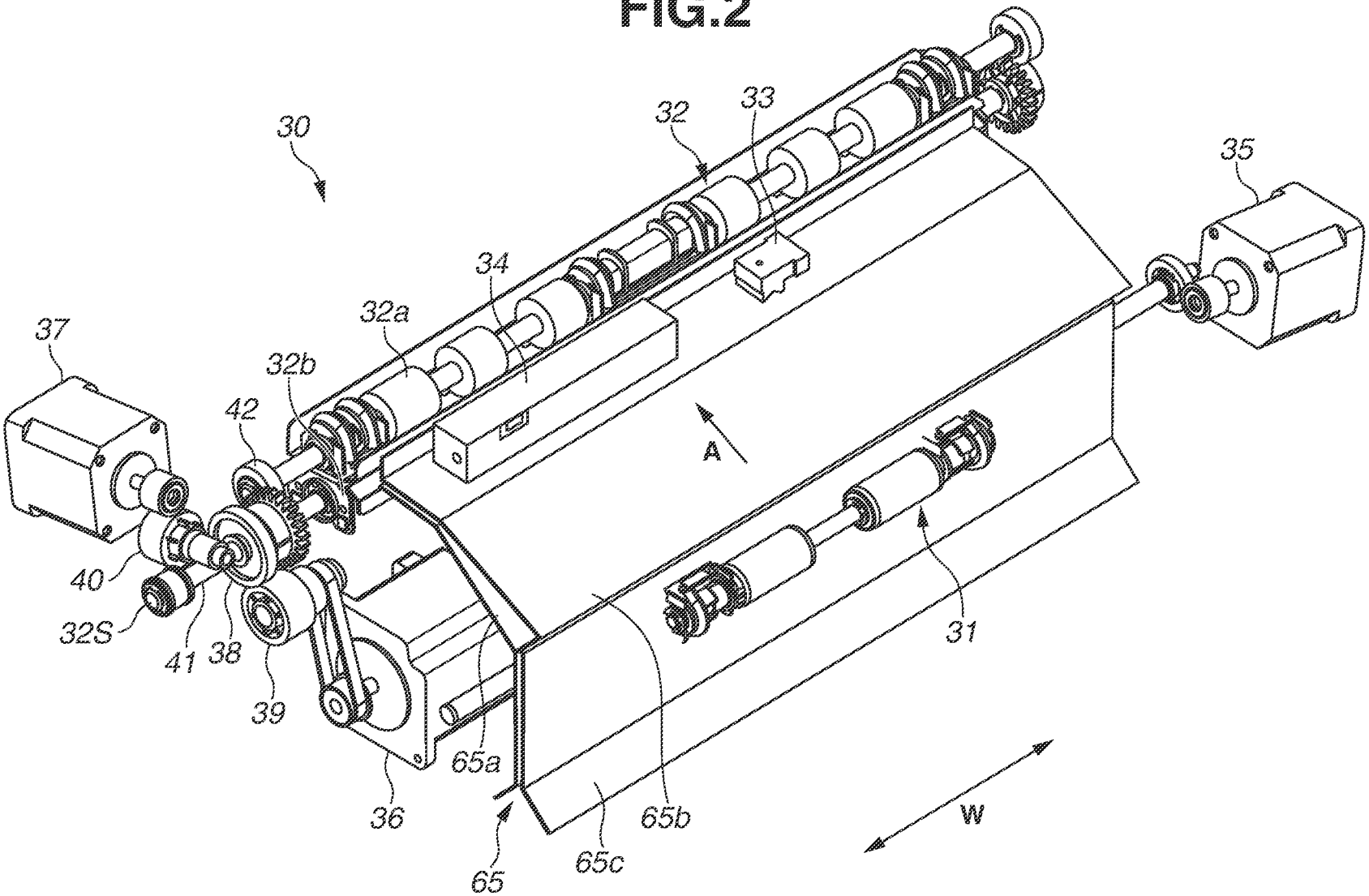
FIG. 2 is a perspective view illustrating a registration unit.

As illustrated in FIGS. 1 and 2, the registration unit 30 is disposed in the conveyance path 65 connecting the drawing unit 20*a* and the secondary transfer nip N. The registration unit 30 includes the registration roller pair 32, the preregistration roller pair 31, the registration sensor 33, and the CIS 34. The preregistration roller pair 31 is located upstream of the registration roller pair 32 in a conveyance direction A of the sheet S. The registration sensor 33 and the CIS 34 are located between the roller pairs 31 and 32.

As illustrated in FIG. 2, the registration roller pair 32 that is a pair of rotating members includes an upper roller 32*a* serving as a first roller and a lower roller 32*b* serving as a second roller that is fixed to a rotation shaft 32S. An input gear 38 is fixed to the rotation shaft 32S, and driven by a registration drive motor 36 via an idler gear 39.

The preregistration roller pair 31 is driven by a preregistration drive motor 35. Each roller in the preregistration roller pair 31 and the registration roller pair 32 rotates about an axis extending in a width direction W.

The rotation shaft 32S supports a rack 41 so that the rack 41 is relatively rotatable and axially immovable with respect to the rotation shaft 32S. The rack 41 receives driving force from a shift motor 37 via a pinion gear 40, and axially shifts the rotation shaft 32S. The upper roller 32*a* is axially shifted in conjunction with the lower roller 32*b*. Moving the registration roller pair 32 in the width direction W orthogonal to the conveyance direction A with the sheet S nipped therebetween moves the sheet S in the width direction W, so that the position of the sheet S in the width direction W is corrected.

The idler gear 39 has a large face width compared with the input gear 38. The reason is to maintain the gears 38 and 39 in mesh with each other and enable rotation of the registration roller 32 even if the registration roller pair 32 and the input gear 38 are moved in the width direction W.

The CIS 34 detects the position of an end of the conveyed sheet S in the width direction W (hereinafter, referred to as an end position). A control unit 200 (see FIG. 3) calculates the amount of deviation between a designed reference position of the sheet S and the end position detected by the CIS 34, and causes the registration unit 30 to make a shift operation by the amount of deviation. This makes the position of the sheet S in the width direction W and a transfer position in the image forming unit 90 the same, so that a high quality product is obtained.

The CIS 34 is located off to one side of the center of the conveyance path 65 in the width direction W. The reason is that the position of the sheet S can be corrected by detecting the end position on either side of the sheet S. The CIS 34 is configured so that the end position of a sheet having a minimum width and that of a sheet having a maximum width among the usable sheet sizes of the image forming apparatus 1 can be detected. To prevent a drop in the detection accuracy of the CIS 34, the CIS 34 is located as close to the registration roller pair 32 as possible.

The registration unit 30 corrects skew of the sheet S by abutting the leading edge of the conveyed sheet S against the nip portion of the registration roller pair 32 at rest to warp the sheet S so that the leading edge of the sheet S lies along the nip portion. The preregistration roller pair 31 feeds the sheet S by a predetermined amount after the leading edge of the sheet S is detected by the registration sensor 33. The sheet S is then conveyed to the secondary transfer nip N by the registration roller pair 32.

An interstice between CIS 34 and a lower guide 65*a* opposed to the CIS 34 is maintained at a constant distance. To allow the sheet S to warp, the lower guide 65*a* and upper guides 65*b* and 65*c* form a predetermined space within the conveyance path 65. The amount of conveyance of the sheet S by the preregistration roller pair 31 is set so that the sheet S warps by an appropriate amount.

[Control Blocks]

Figure 3:
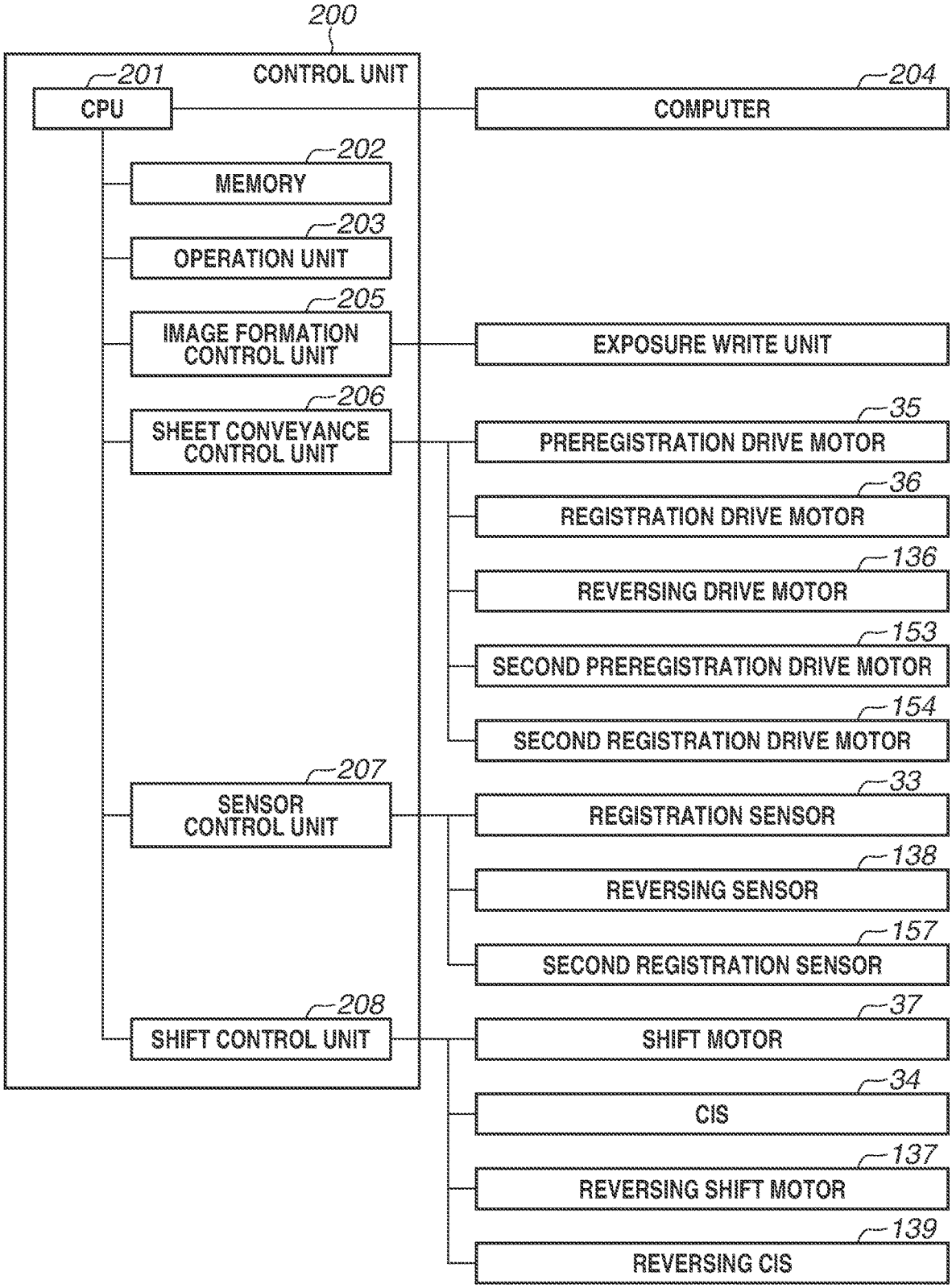
FIG. 3 is a control block diagram illustrating a control unit.

FIG. 3 is a control block diagram illustrating the control unit 200 of the image forming apparatus 1. The control unit 200 includes a central processing unit (CPU) 201, a memory 202, an operation unit 203, an image formation control unit 205, a sheet conveyance control unit 206, a sensor control unit 207, and a shift control unit 208. The CPU 201 implements various types of processing for the image forming apparatus 1 to perform by executing predetermined control programs. The memory 202 includes a random access memory (RAM) and a read-only memory (ROM), for example, and stores various programs and various types of data in predetermined storage areas. The operation unit 203 serving as an obtaining unit accepts input of various types of information about sheets (e.g., sheet size, sheet grammage, and surface properties of sheets) and instructions to execute and cancel jobs.

The image formation control unit 205 issues instructions to the image forming unit 90 including the exposure devices 93, 96, 97, and 98, and controls the image forming operation. The sheet conveyance control unit 206 issues instructions to the preregistration drive motor 35, the registration drive motor 36, a reversing drive motor 136, a second preregistration drive motor 153, a second registration drive motor 154, and the like. The conveyance operation of the sheet S is thereby controlled. The sensor control unit 207 issues detection start and detection end instructions to the registration sensor 33, a reversing sensor 138, a second registration sensor 157, and the like, and receives detection results from the sensors.

The shift control unit 208 receives detection results from the CIS 34 and a reversing CIS 139, and issues driving start and driving stop instructions to the shift motor 37 and a reversing shift motor 137, thus controlling the movement of the sheet S in the width direction W, i.e., a shift operation. The CPU 201 can connect to an external computer 204 connected via a network, for example, and can receive various types of information about sheets and print jobs from the computer 204.

[Skew Correction Operation and Shift Operation by Registration Unit]

Figure 4:
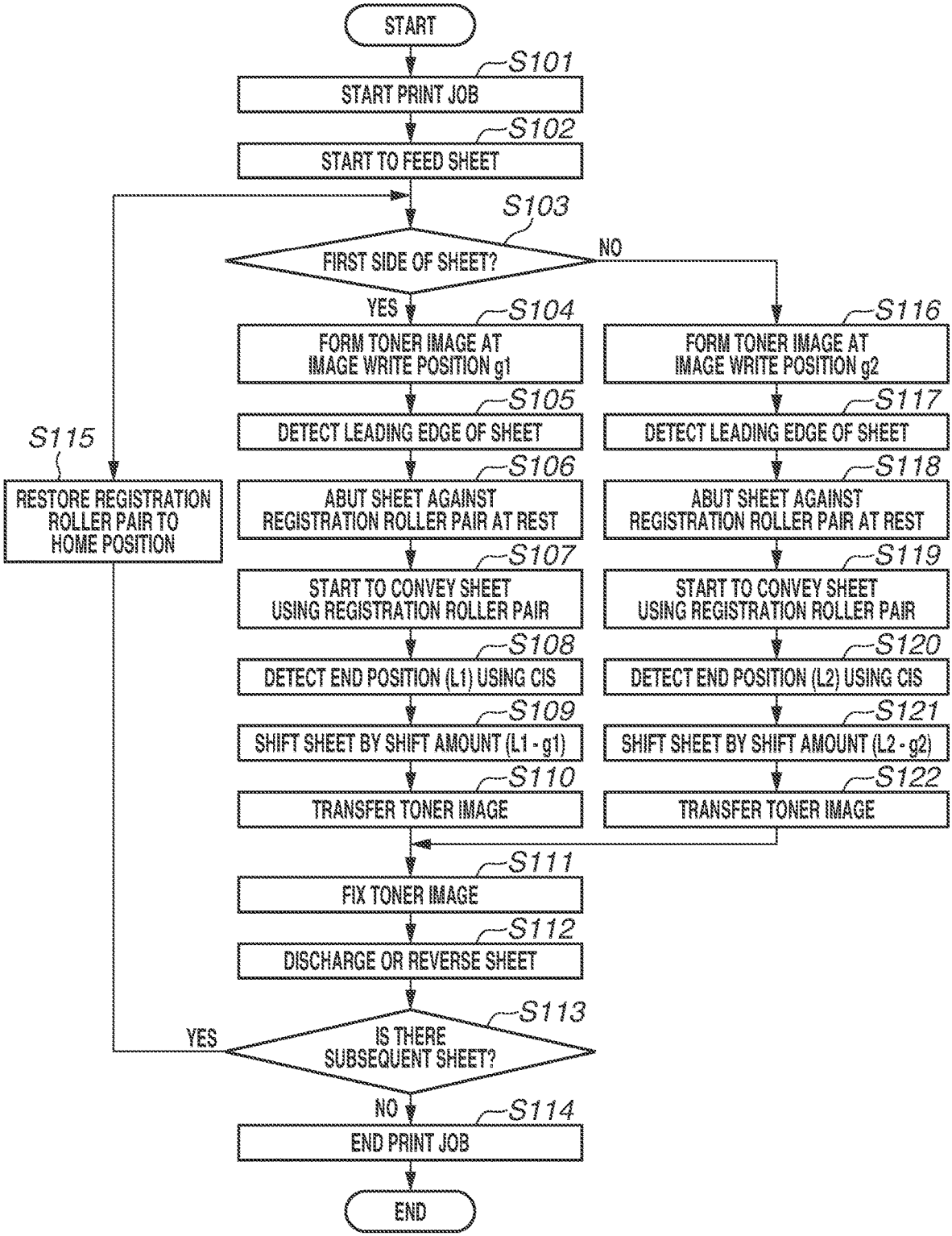
FIG. 4 is a flowchart illustrating a skew correction operation and a shift operation to be performed by the registration unit.

Next, a skew correction operation (first skew correction operation) and a shift operation to be performed by the registration unit 30 will be described with reference to the flowchart illustrated in FIG. 4. In step S101, a print instruction is initially input from the operation unit 203 or the computer 204, and the control unit 200 starts a print job. The user can issue instructions about the number of copies to be printed and specify the type of sheet to be used for printing from the operation unit 203 or the computer 204.

In step S102, the control unit 200 starts to feed a sheet S. In step S103, the control unit 200 determines which side of the sheet is to be printed in the print job, the first side or the second side. If the first side of the sheet is determined to be printed (YES in step S103), the processing proceeds to step S104. In step S104, the control unit 200 controls the image forming unit 90 to form a toner image at a predetermined first-side image write position g1 of the intermediate transfer belt 50. As employed herein, the image write position g1 has a value based on the result of a write position adjustment made at factory shipment, and stored in the memory 202 as a fixed value specific to the apparatus main body.

More specifically, the control unit 200 controls the exposure devices 93, 96, 97, and 98 to form electrostatic latent images on the photosensitive drums of the process cartridges 99Y, 99M, 99C, and 99Bk at respective positions corresponding to the image write position g1. As described above, the electrostatic latent images formed on the photosensitive drums are developed into toner images by the developing devices. The toner images are transferred to the intermediate transfer belt 50 by the primary transfer rollers 55Y, 55M, 55C, and 55Bk.

Figure 5A:
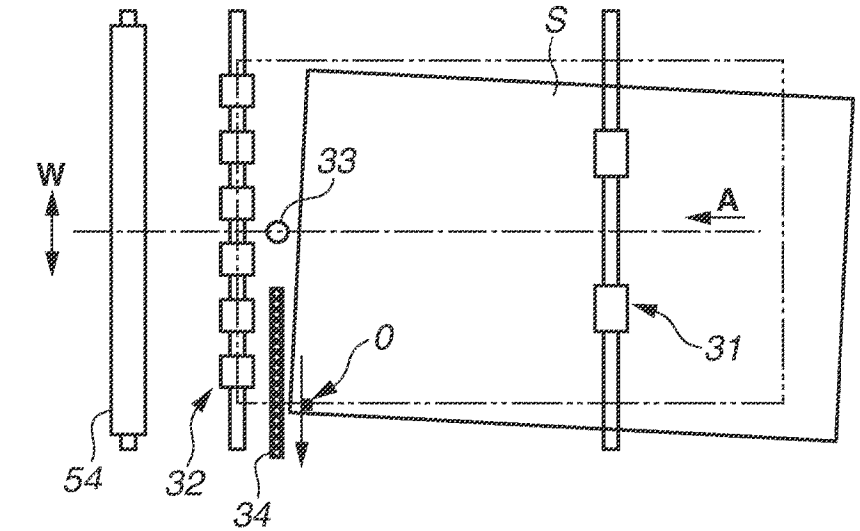
FIG. 5A is a plan view illustrating a state where a sheet is conveyed askew toward a registration roller pair.

Meanwhile, the sheet S is conveyed up to the preregistration roller pair 31. Suppose, as illustrated in FIG. 5A, that the sheet S conveyed here is rotated clockwise with respect to the conveyance direction A and skewed, and deviates to the left of the conveyance direction A. The dotted-lined rectangles illustrated in FIGS. 5A to 5D schematically indicate a state where the leading edge of the sheet S conveyed without skew or lateral deviation is abutted against the nip portion of the registration roller pair 32. With the end position of the sheet S in the width direction W here as a zero point, the left side will be referred to as positive.

Figure 5B:
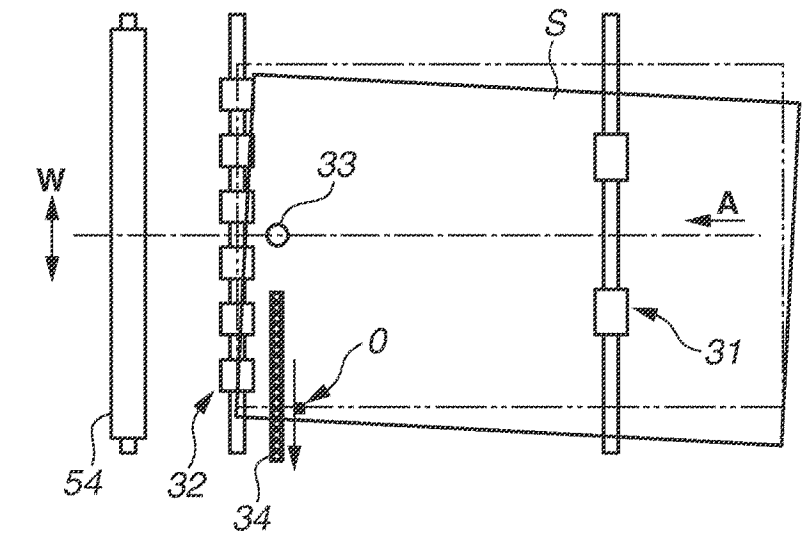
FIG. 5B is a plan view illustrating a state where an end position of the sheet abutted against the registration roller pair is detected.
Figure 5C:
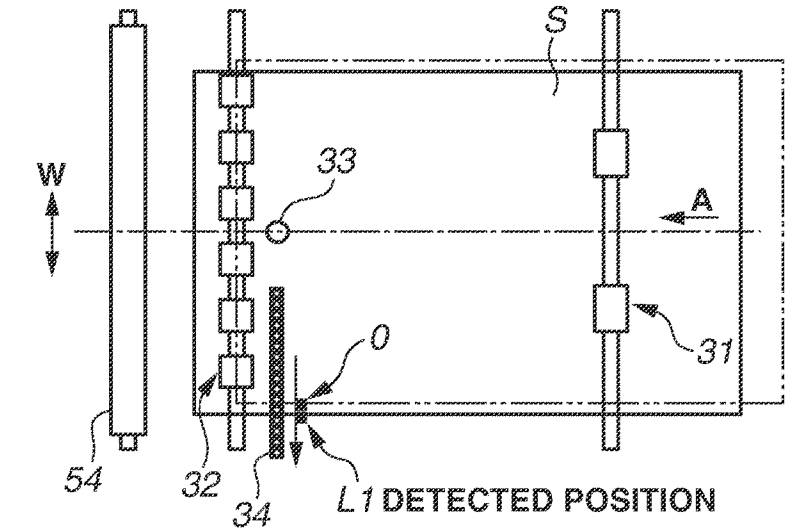
FIG. 5C is a plan view illustrating a state where the sheet is conveyed by the registration roller pair.
Figure 5D:
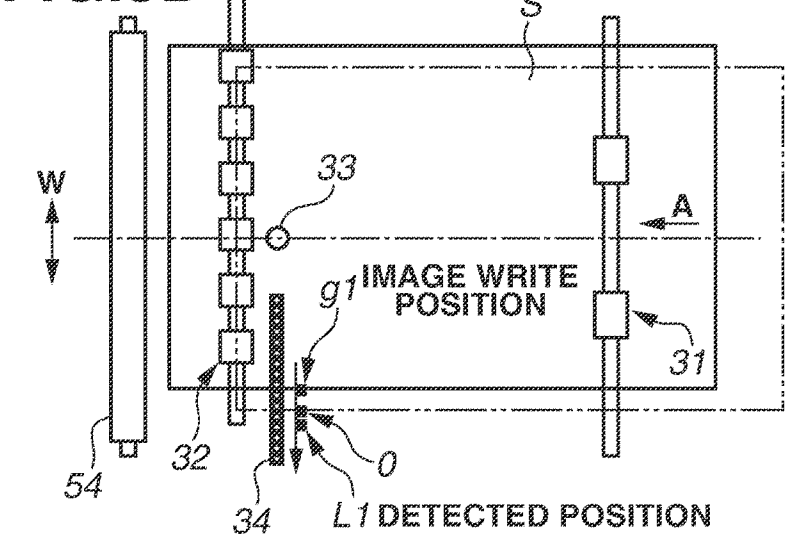
FIG. 5D is a plan view illustrating a state where the sheet is shifted by the registration roller pair.

In step S105, the registration sensor 33 detects the leading edge of the sheet S. In step S106, the control unit 200 feeds the sheet S by a set feed amount using the preregistration roller pair 31 based on the result of the detection made by the registration sensor 33. The sheet S is thus abutted against the registration roller pair 32 at rest as illustrated in FIG. 5B, and warps by a predetermined amount. The skew of the sheet S is thus corrected. In step S107, the sheet S is nipped and conveyed by the registration roller pair 32 started to be driven to rotate as illustrated in FIG. 5C. The skew correction on the sheet S using the registration sensor 33 is performed regardless of the length of the sheet S in the conveyance direction A.

In step S108, the CIS 34 detects the end position of the skew-corrected sheet S. The control unit 200 calculates a shift amount of the sheet S based on the result (L1) of the detection. Here, the shift amount can be determined by subtracting the image write position (g1) from the result (L1) of the detection made by the CIS 34 (L1−g1).

In step S109, the control unit 200 moves the registration roller pair 32 nipping the sheet S in the width direction W by the shift amount (L1−g1) via the shift control unit 208 and the shift motor 37. The sheet S can thus be moved in the width direction W by the shift amount (L1−g1). Thus, the position of the sheet S in the width direction W is corrected to correspond to the image write position g1. The shift of the sheet S in the width direction using the registration sensor 33 is performed regardless of the length of the sheet S in the conveyance direction A.

In step S110, at the secondary transfer nip N, the toner image on the intermediate transfer belt 50 is transferred to the sheet S shifted by the registration roller pair 32 as much as the shift amount (L1−g1). In step S111, the toner image is melted and fixed by the fixing unit 100.

In step S112, if the print job is a one-sided print job, the sheet S to which the toner image has been fixed is discharged to the discharge tray 171. If the print job is a two-sided print job, the sheet S is subjected to reversing processing for the sake of image formation on the second side. In step S113, the control unit 200 determines whether there is a subsequent sheet. If the control unit 200 determines that there is no subsequent sheet (NO in step S113), the processing proceeds to step S114. In step S114, the control unit 200 ends the print job. If the control unit 200 determines that there is a subsequent sheet (YES in step S113), the processing proceeds to step S115. In step S115, the control unit 200 restores the registration roller pair 32 to its home position (center position). The processing then returns to step S103.

In step S103, if the control unit 200 determines that the second side is to be printed in the print job (NO in step S103), the processing proceeds to step S116. In step S116, the control unit 200 controls the image forming unit 90 to form a toner image at a second-side image write position g2. The second-side image write position g2 may be the same as or different from the first-side image write position g1 in the width direction W. The skew correction operation by the registration roller pair 32 on the sheet on the second side of which an image is to be formed is similar to that to be performed on the sheet on the first side of which an image is to be formed. A description thereof will thus be omitted (steps S117 to S119).

In step S120, the CIS 34 detects the end position of the second side of the skew-corrected sheet S. The control unit 200 calculates the shift amount of the sheet S based on the result (L2) of the detection. The shift amount here can be determined by subtracting the image write position (g2) from the result (L2) of the detection made by the CIS 34 (L2−g2).

In step S121, the control unit 200 moves the registration roller pair 32 nipping the sheet S in the width direction W by the shift amount (L2−g2) via the shift control unit 208 and the shift motor 37 constituting another moving unit. The sheet S can thus be moved in the width direction W by the shift amount (L2−g2). For example, if the second-side image write position g2=the first-side image write position g1=0, the sheet S shifted by the shift amount L2 comes to the same position as before the image formation on the first side. This makes the positions of the images formed on the first side and the second side the same. Moreover, the images are formed at the center of the sheet S. A high quality product can thus be obtained.

In step S122, at the secondary transfer nip N, the toner image on the intermediate transfer belt 50 is transferred to the sheet S shifted by the registration roller pair 32 as much as the shift amount (L2−g2). In step S111, as in the processing on the first side, the toner image is melted and fixed by the fixing unit 100. In step S112, the sheet S to which the toner image is fixed is discharged to the discharge tray 171.

The printing of the second side involves conveyance over a long distance after the skew and lateral deviation of the first side are corrected by the registration unit 30. The skew and lateral deviation of the second side are therefore often greater than in the printing of the first side, because of variations in the parts of the units. This may increase the shift amount of the registration roller pair 32. When the registration roller pair 32 is shifted, the sheet S slides over conveyance guide members with high resistance. The resistance of a large-sized sheet S is particularly high since the sheet S is nipped by other rollers. If the shift amount is large, shifting the registration roller pair 32 can skew the sheet S, make the shift amount of the sheet S smaller than expected, and/or crease the sheet S because of the resistance.

Moreover, if the shift amount is large, it takes longer to shift the registration roller pair 32 and to restore the registration roller pair 32 to the home position (center position) after the sheet S exits the registration roller 32. This may hinder productivity. To reduce such issues, in the present exemplary embodiment, the reversing conveyance unit 130 also performs a shift operation (lateral registration shift) on the sheet S.

[Reversing Conveyance Unit]

Figure 6:
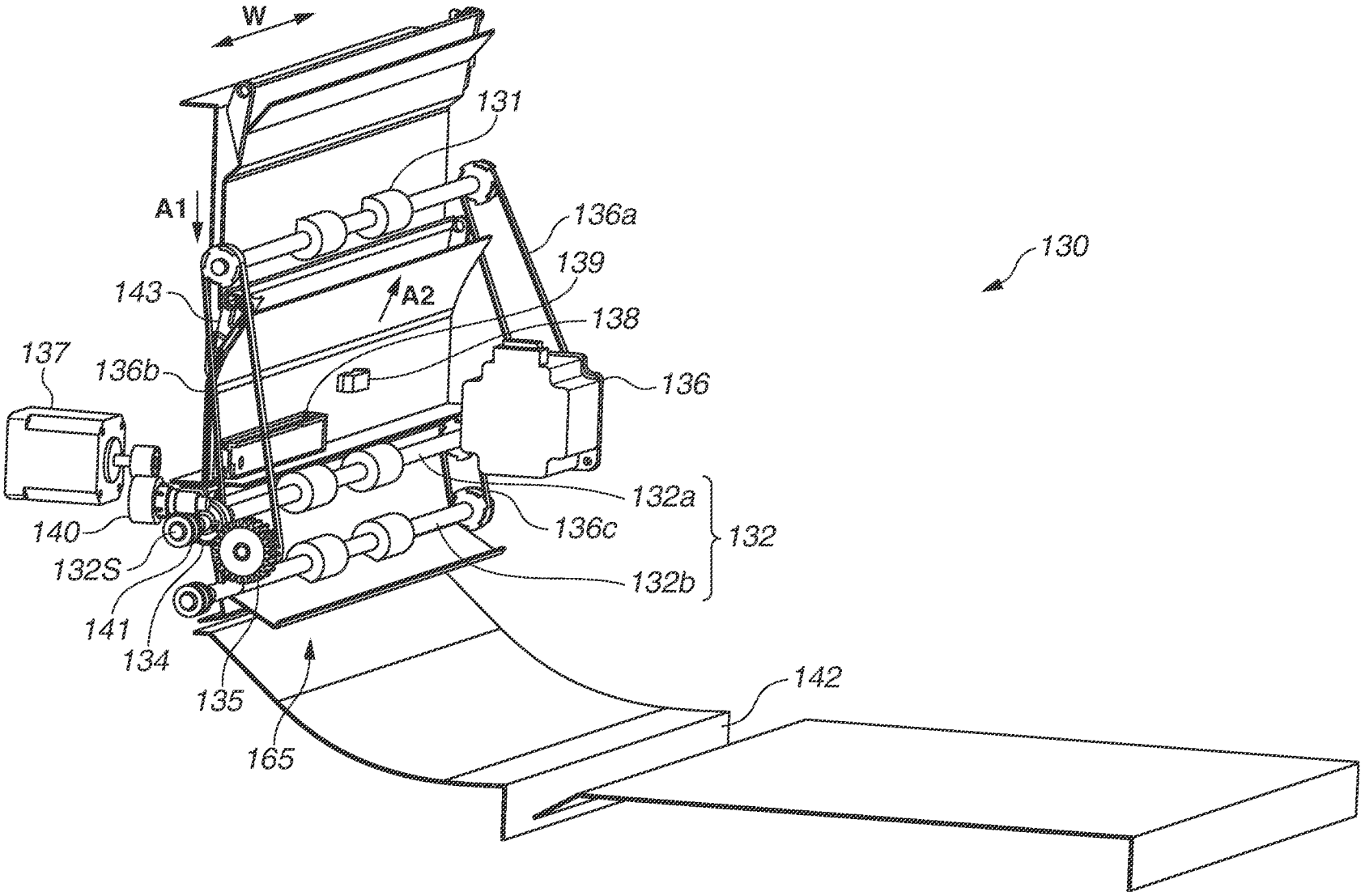
FIG. 6 is a perspective view illustrating a reversing conveyance unit.

Next, a configuration of the reversing conveyance unit 130 will be described. As illustrated in FIG. 6, the reversing conveyance unit 130 serving as a reversing unit includes a conveyance roller pair 131, a reversing shift unit 132 serving as a second moving unit, the reversing sensor 138, the reversing CIS 139 serving as a second detection unit, and a switching member 143. The reversing shift unit 132 includes a first reversing shift roller pair 132*a* and a second reversing shift roller pair 132*b* serving as reversing rollers. The reversing sensor 138 and the reversing CIS 139 are located between the conveyance roller pair 131 and the first reversing shift roller pair 132*a*.

The conveyance roller pair 131 is driven by the reversing drive motor 136 via a belt 136*a*. The rotation of the conveyance roller pair 131 is transmitted to an idler gear 135 via a belt 136*b*. An input gear 134 is fixed to a rotation shaft 132S of the first reversing shift roller pair 132*a*. The input gear 134 is driven by the idler gear 135. The first reversing shift roller pair 132*a* and the second reversing shift roller pair 132*b* are connected by a belt 136*c* and configured to move together. Each roller in the first and second reversing shift roller pairs 132*a* and 132*b* rotates about an axis extending in the width direction W. For example, the first reversing shift roller pair 132*a* includes a third roller and a fourth roller each rotating about an axis extending in the width direction W. The third and fourth rollers move in the width direction W with the sheet S nipped therebetween.

The rotation shaft 132S supports a rack 141 so that the rack 141 is relatively rotatable and axially immovable with respect to the rotation shaft 132S. The rack 141 receives driving force from the reversing shift motor 137 serving as a moving unit via a pinion gear 140, and axially shifts the rotation shaft 132S. Moving the first reversing shift roller pair 132*a* and the second reversing shift roller pair 132*b* in the width direction W with the sheet S nipped therebetween moves the sheet S in the width direction W, so that the position of the sheet S in the width direction W is corrected. In such a manner, the shift operation by the reversing conveyance unit 130 is implemented.

The idler gear 135 has a large face width compared with the input gear 134. The reason is to maintain the gears 134 and 135 in mesh with each other and enable rotation of the reversing shift unit 132 even if the first reversing shift roller pair 132*a* and the input gear 134 are moved in the width direction W.

The reversing CIS 139 is located off to one side of the center of a reversing conveyance path 165 in the width direction W, and detects the end position of the conveyed sheet S in the width direction W.

The reason is that the position of the sheet S can be corrected by detecting the end position of either side of the sheet S. To prevent a drop in the detection accuracy of the reversing CIS 139, the reversing CIS 139 is located as close to the first reversing shift roller pair 132*a* as possible.

[Shift Operation by Reversing Conveyance Unit]

Figure 7:
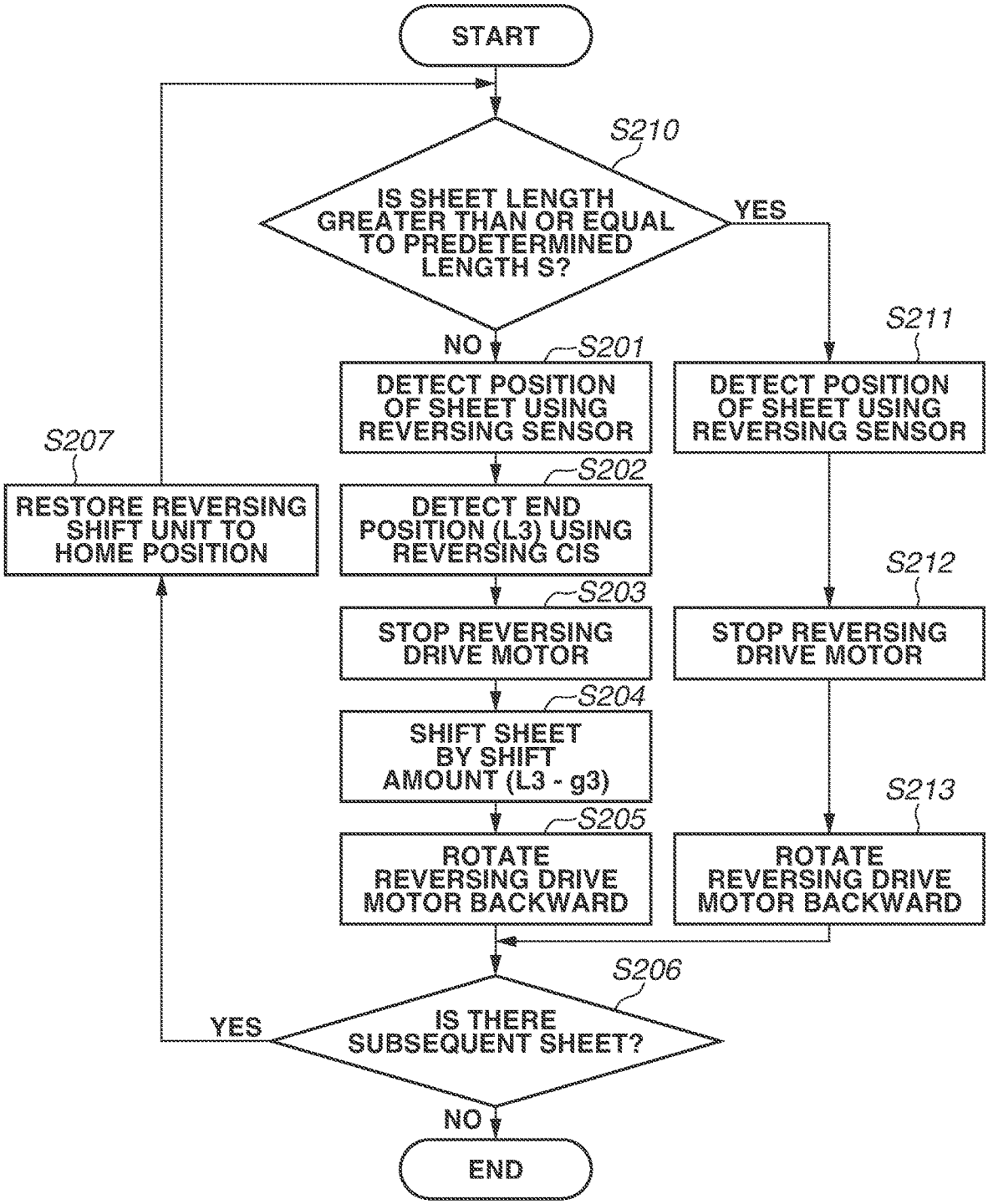
FIG. 7 is a flowchart illustrating a shift operation to be performed by the reversing conveyance unit.
Figure 8A:
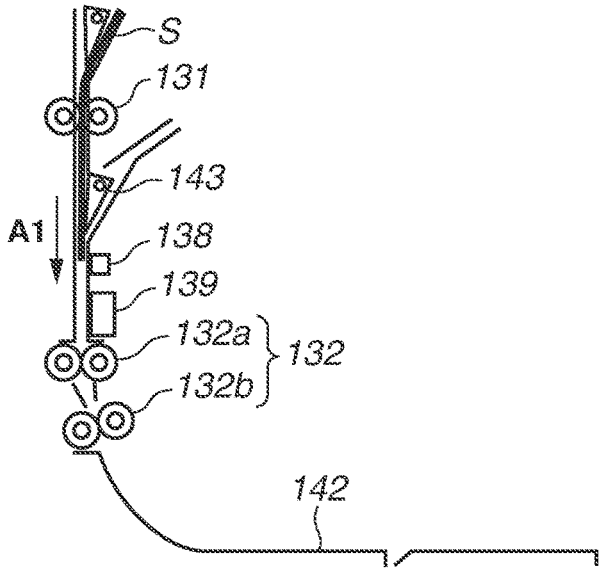
FIG. 8A is a schematic diagram illustrating a state where a sheet is conveyed toward a reversing shift unit.

Next, the shift operation by the reversing conveyance unit 130 will be described with reference to the flowchart illustrated in FIG. 7. If the print job is a two-sided print job, the sheet S on the first side of which an image has been formed is conveyed to the reversing conveyance unit 130 by the branching conveyance unit 120. The switching member 143 of the reversing conveyance unit 130 is biased in position by a biasing member as illustrated in FIG. 8A.

The sheet S conveyed from the branching conveyance unit 120 is conveyed to the conveyance roller pair 131 and further conveyed while pressing the switching member 143 against the biasing force of the biasing member. In step S210, the control unit 200 makes a determination based on information about the length of the sheet S in the conveyance direction A, input to and obtained by the operation unit 203. More specifically, in step S210, the control unit 200 determines whether the length of the sheet S in the conveyance direction A, input to the operation unit 203 is greater than or equal to a predetermined length S. If the length of the sheet S is determined to not be greater than or equal to the length S (NO in step S210), the processing proceeds to step S201. In step S201, the reversing sensor 138 detects the position of the sheet S in the conveyance direction A. In step S202, the reversing CIS 139 detects the end position of the sheet S. The control unit 200 calculates the shift amount of the sheet S based on the result (L3) of the detection and the amount of deviation g3. The amount of deviation g3 refers to the amount by which the sheet S deviates in the width direction W when conveyed from the reversing conveyance unit 130 to the registration unit 30. The amount of deviation g3 is obtained in advance in installation of the image forming apparatus 1 or other timings. The shift amount of the sheet S can be determined by subtracting the amount of deviation g3 from the result (L3) of the detection made by the reversing CIS 139 (L3−g3).

Figure 8B:
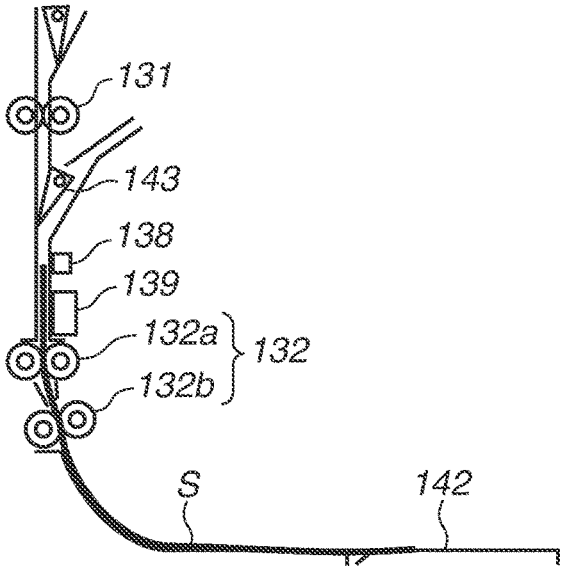
FIG. 8B is a schematic diagram illustrating a state where the sheet is stopped by the reversing shift unit.

In step S203, the control unit 200 stops driving the reversing drive motor 136 to stop the sheet S with the trailing edge of the sheet S a predetermined distance ahead of the switching member 143 as illustrated in FIG. 8B, based on the result of the detection made by the reversing sensor 138.

In step S204, after the sheet S is stopped, the control unit 200 moves the reversing shift unit 132 nipping the shift S in the width direction W by the shift amount (L3−g3) via the shift control unit 208 and the reversing shift motor 137. This enables the sheet S to be shifted in the width direction W by the shift amount (L3−g3).

In step S205, the control unit 200 rotates the reversing drive motor 136 backward in parallel with the foregoing shift operation. The sheet S is thus switched back by the first and second reversing shift roller pairs 132*a* and 132*b* of the reversing shift unit 132. In other words, the sheet S is conveyed in a first direction A1 (see FIG. 8A) and then conveyed in a second direction A2 opposite to the first direction A1 (see FIG. 8C).

Figure 8C:
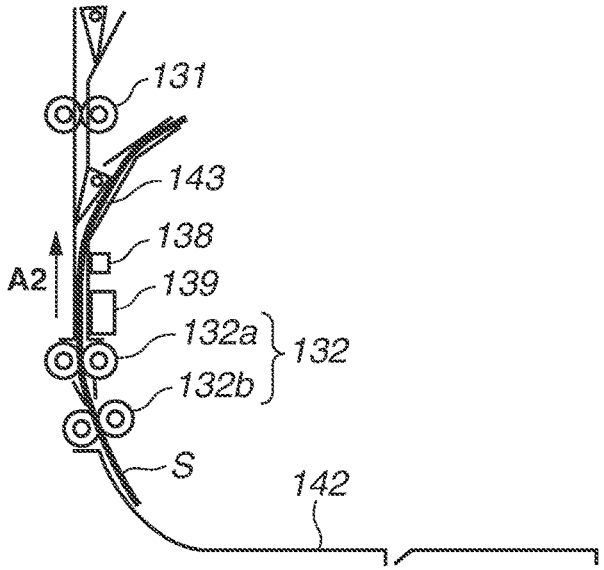
FIG. 8C is a schematic diagram illustrating a state where the reversed sheet is conveyed by the reversing shift unit.

During the switchback operation, the sheet S is slid over and guided by a reversing guide 142 serving as a guide member. Here, the second side opposite the image-formed first side of the sheet S makes sliding contact with the reversing guide 142. There is no guide member disposed opposite the reversing guide 142, and the first side of the sheet S guided by the reversing guide 142 is not guided by other guide members. As illustrated in FIG. 8C, the sheet S is guided to the second two-sided conveyance unit 150 by the switching member 143, and image formation on the second side is performed.

In step S206, the control unit 200 determines whether there is a subsequent sheet. If the control unit 200 determines that there is no subsequent sheet (NO in step S206), the shift operation by the reversing conveyance unit 130 ends. If the control unit 200 determines that there is a subsequent sheet (YES in step S206), the processing proceeds to step S207. In step S207, the control unit 200 restores the reversing shift unit 132 to its home position (center position). The processing then returns to step S201.

In step S210, if the control unit 200 determines that the length of the sheet S in the conveyance direction A is greater than or equal to the predetermined length S (YES in step S210), the processing proceeds to step S211. In step S211, the reversing sensor 138 detects the sheet S. In step S212, the control unit 200 stops driving the reversing drive motor 136 based on the detection of the sheet S. In step S213, the control unit 200 rotates the reversing drive motor 136 backward. The processing proceeds to step S206. In other words, if the control unit 200 determines that the length of the sheet S is greater than or equal to the predetermined length S, the shift operation by the reversing conveyance unit 130 is not performed.

In the present exemplary embodiment, step S205 is performed after step S204. However, steps S204 and S205 may be performed in reverse order or simultaneously.

[Second Two-Sided Conveyance Unit]

Figure 9:
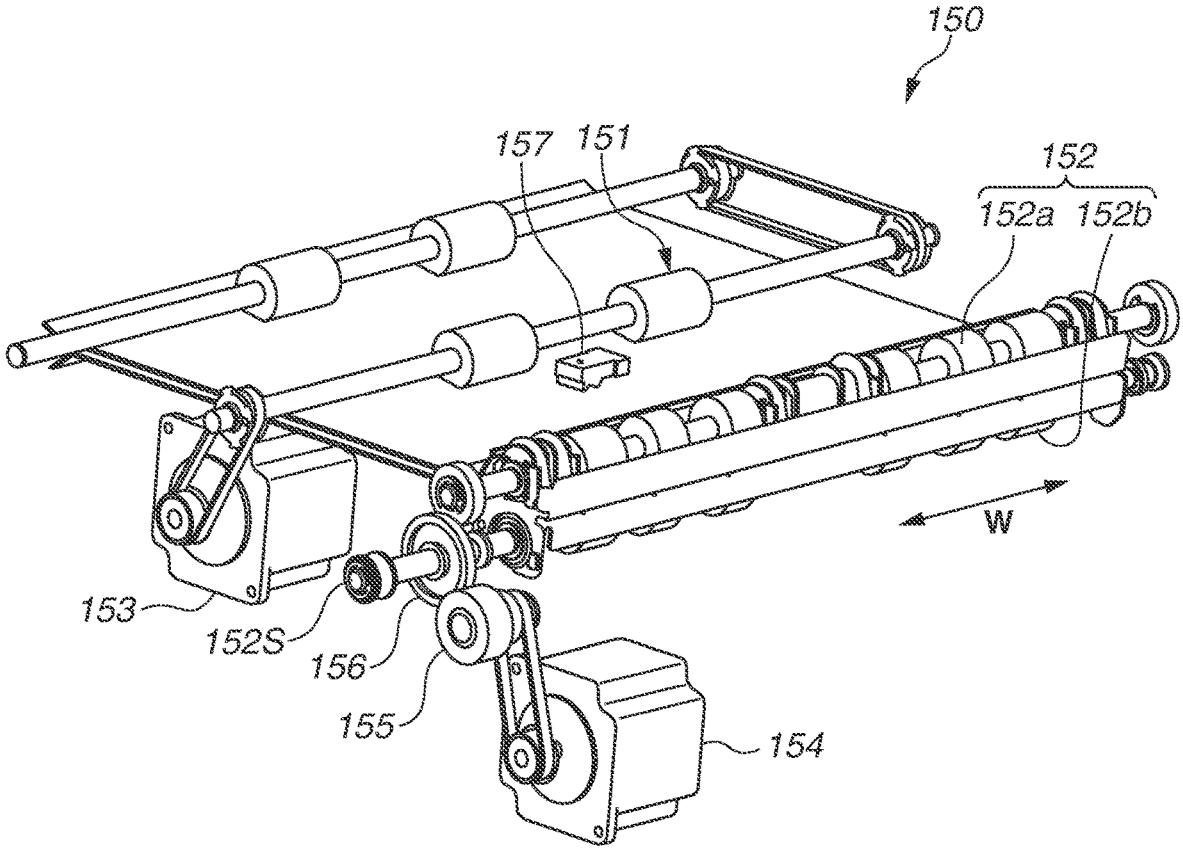
FIG. 9 is a perspective view illustrating a second two-sided conveyance unit.

Next, a configuration of the second two-sided conveyance unit 150 will be described. As illustrated in FIG. 9, the second two-sided conveyance unit 150 serving as a two-sided conveyance unit includes a second registration roller pair 152 serving as a skew correction unit, a second preregistration roller pair 151, and the second registration sensor 157. The second preregistration roller pair 151 is located upstream of the second registration roller pair 152 in the conveyance direction A of the sheet S. The second registration sensor 157 is located between the roller pairs 151 and 152.

The second registration roller pair 152 that is a pair of rotating members includes an upper roller 152*a* and a lower roller 152*b* that is fixed to a rotation shaft 152S. An input gear 156 is fixed to the rotation shaft 152S. The input gear 156 is driven by the second registration drive motor 154 via an idler gear 155. The second preregistration roller pair 151 is driven by the second preregistration drive motor 153.

The second two-sided conveyance unit 150 is disposed in the housing 1B, and corrects the skew of the sheet S before the sheet S is discharged from the housing 1B to the housing 1A. The second two-sided conveyance unit 150 performs the skew correction operation on the sheet S but not a shift operation.

[Skew Correction Operation by Second Two-Sided Conveyance Unit]

Figure 10:
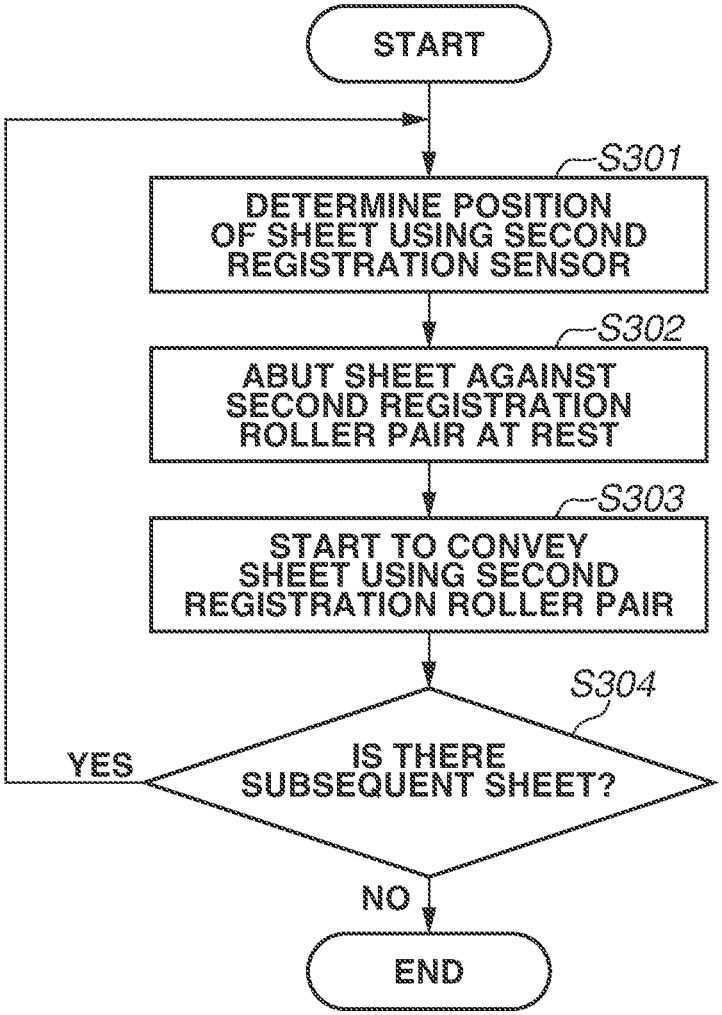
FIG. 10 is a flowchart illustrating a skew correction operation by the second two-sided conveyance unit.

Next, the skew correction operation (second skew correction operation) to be performed by the second two-sided conveyance unit 150 will be described with reference to the flowchart illustrated in FIG. 10. If the print job is a two-sided print job, the sheet S on the first side of which an image has been formed is subjected to the shift operation by the reversing conveyance unit 130 as described above. In step S301, the second registration sensor 157 then detects the position of the sheet S conveyed from the reversing conveyance unit 130 to the two-sided conveyance unit 150 in the conveyance direction A.

In step S302, the control unit 200 feeds the sheet S by the set feed amount using the second preregistration roller pair 151 based on the result of the detection made by the second registration sensor 157. Thus, the sheet S is abutted against the second registration roller pair 152 at rest and warps by a predetermined amount. Thus, the skew of the sheet S is corrected. In step S303, the sheet S is nipped and conveyed by the second registration roller pair 152 started to be driven to rotate. The skew correction on the sheet S using the second registration roller pair 152 is performed regardless of the length of the sheet S in the conveyance direction A.

In step S304, the control unit 200 determines whether there is a subsequent sheet. If the control unit 200 determines that there is no subsequent sheet (NO in step S304), the skew correction operation by the second two-sided conveyance unit 150 ends. If the control unit 200 determines that there is a subsequent sheet (YES in step S304), the processing returns to step S301.

As described above, in the present exemplary embodiment, a two-sided print job involves shift operations at two locations, the reversing conveyance unit 130 and the registration unit 30, after the image formation on the first side of the sheet S. The shift amount of the sheet S can thus be distributed between the shift operations at the two locations. During the shift operation performed by the reversing conveyance unit 130, the sheet S is not nipped by any rollers other than those of the reversing shift unit 132 performing the shift operation. In other words, the shift operation can be stably performed without a resistance from the sheet S being nipped by rollers other than those of the reversing shift unit 132 regardless of the size of the sheet S.

Figure 14A:
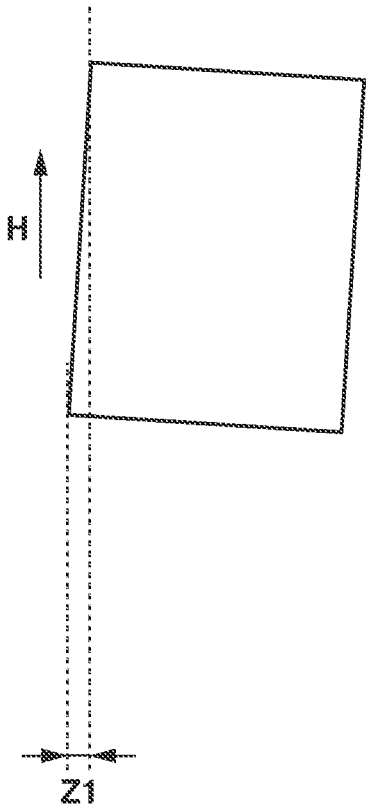
FIGS. 14A and 14B are diagrams illustrating the states of sheets being conveyed askew.
Figure 14B:
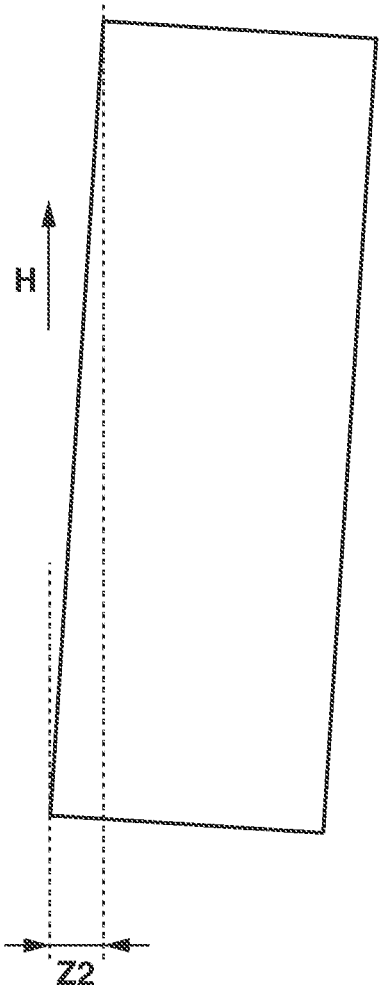

If the length of the sheet S in the conveyance direction A is less than the predetermined length S (for example, is a first length), the sheet S is shifted by the reversing conveyance unit 130. On the other hand, if the length of the sheet S in the conveyance direction A is greater than or equal to the predetermined length S (for example, is a second length greater than the first length), the shift operation for the sheet S by the reversing conveyance unit 130 is not performed. This prevents the occurrence of the following trouble due to shifting of a long sheet. FIG. 14A illustrates a state where a first sheet having the first length is conveyed askew in a conveyance direction H. FIG. 14B illustrates a state where a second sheet having the second length greater than the first length, skewed by the same angle as that of the first sheet of FIG. 14A is conveyed in the conveyance direction H. The amount of positional deviation in the width direction between the corner at one end of the second sheet in the conveyance direction H and the corner of the second sheet at the other end in the conveyance direction H will be referred to as the amount of deviation Z2. The amount of deviation Z2 is greater than the amount of positional deviation Z1 in the width direction between the corner at one end of the first sheet in the conveyance direction H and the corner at the other end of the first sheet in the conveyance direction H. If the second sheet is shifted in the width direction with the vicinity of the one end (leading edge side) of the second sheet nipped by the reversing conveyance unit 130, the corner at the other end (trailing edge side) of the second sheet may deviate greatly from normal positions in the width direction. This may cause the trouble that the side edge of the second sheet including the corner at the trailing edge of the second sheet can contact other members of the image forming unit 90 (members with which sheets are not supposed to make contact) and be damaged. In the present exemplary embodiment, if the length of the sheet S is greater than or equal to the predetermined length S (e.g., is the second length greater than the first length), the shift operation for the sheet S by the reversing conveyance unit 130 is therefore not performed. The present exemplary embodiment can thus avoid the foregoing trouble. In the present exemplary embodiment, the skew of a sheet S even having a length greater than the predetermined length S is corrected by the second registration roller pair 152 and by the registration roller pair 32. A long sheet passed through the reconveyance unit 500 can thus be shifted in the width direction W using the registration roller pair 32.

Moreover, the sheet S to be switched back by the reversing shift unit 132 is guided by the reversing guide 142 at the second side where no image has been formed. Since there is no guide member disposed opposite the reversing guide 142, the first side of the sheet S that is the image side is not guided by any guide member. The image side where an image has been formed has high friction resistance. Guiding only the second side that is not the image side with the reversing guide 142 can thus reduce the sliding resistance between the sheet S and the reversing guide 142. This reduces resistance in the shift operation performed by the reversing shift unit 132 as well.

In addition, the reversing shift unit 132 shifts the first reversing shift roller pair 132*a* and the second reversing shift roller pair 132*b* in the width direction W at the same time. Performing the shift operation with the sheet S nipped by the two roller pairs can reduce skew due to the occurrence of a slip between the sheet S and the rollers during the shift operation, and enables a stable shift operation. The skew and lateral deviation of the sheet S can thus be reduced to obtain a high quality product. In particular, in the present exemplary embodiment, the skew and lateral deviation of the first sheet S in a job can be reduced in forming an image on the second side of the sheet S. The image forming apparatus 1 according to the present exemplary embodiment can thus provide high quality products early compared with an apparatus that corrects the position of a subsequent sheet based on the position of a preceding sheet.

The small shift amounts of the reversing conveyance unit 130 and the registration unit 30 reduce the time to restore the roller pairs to their home positions after a shift operation, thus improving productivity.

The registration unit 30 is disposed in the housing 1A, and the reversing conveyance unit 130 in the housing 1B. Since the shift operations are performed in the respective separate housings, lateral deviations can be corrected within each housing. Since the sheet S is conveyed to another housing after the lateral deviation correction in each housing, the shift amount of the sheet S in each housing can be reduced. This can reduce the lengths of the guide members forming the conveyance paths in the width direction W, and enables a cost reduction and space saving.

Furthermore, in the present exemplary embodiment, a two-sided print job involves performing skew correction operations at two locations, the two-sided conveyance unit 150 and the registration unit 30, after the image formation on the first side of the sheet S. The amount of skew correction to the sheet S can thus be distributed between the skew correction operations at the two locations, so that the amounts of skew correction at the respective locations can be reduced. Since skew correction operations warp the sheet S, the sheet S can be distorted and creased if the amount of skew correction is large. In the present exemplary embodiment, the sheet S can be prevented from creasing, since the amounts of skew correction can be reduced.

The registration unit 30 is disposed in the housing 1A, and the two-sided conveyance unit 150 in the housing 1B. Since the skew correction operations are performed in the respective separate housings, skew can be corrected within each housing. Since the sheet S is conveyed to another housing after the skew correction in each housing, the amounts of skew correction to the sheet S in the respective housings can be reduced. Skew correction performance desirable for each housing can thus be defined, and skew correction mechanisms capable of skew correction with appropriate amounts, without excess or deficiency, can be selected.

Next, a second exemplary embodiment of the present disclosure will be described. In the second exemplary embodiment, a reversing conveyance unit 130 does not perform a shift operation, and a second two-sided conveyance unit 180 performs a skew correction operation and a shift operation. Components similar to those of the first exemplary embodiment will be omitted from the drawings or illustrated and described with the same reference numerals.

[Second Two-Sided Conveyance Unit]

A configuration of the two-sided conveyance unit 180 according to the second exemplary embodiment will initially be described.

Figure 11:
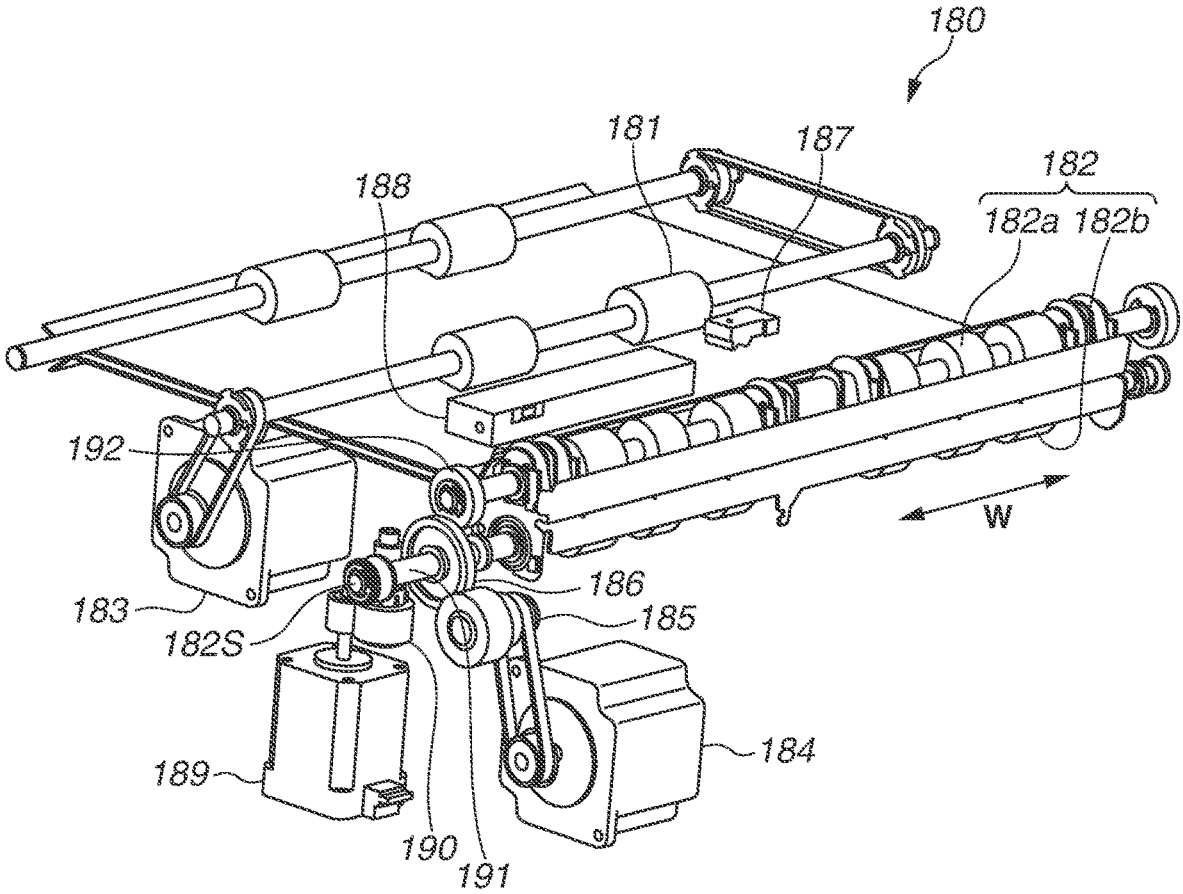
FIG. 11 is a perspective view illustrating a second two-sided conveyance unit according to a second exemplary embodiment.

As illustrated in FIG. 11, the second two-sided conveyance unit 180 includes a second registration roller pair 182 serving as a second moving unit and a second skew correction unit, and a second preregistration roller pair 181. The second two-sided conveyance unit 180 further includes a second registration sensor 187 and a second CIS unit 188. The second preregistration roller pair 181 is located upstream of the second registration roller pair 182 in the conveyance direction A of a sheet S. The second registration sensor 187 and the second CIS 188 are located between the roller pairs 181 and 182.

The second registration roller pair 182 that is a pair of rotating members includes an upper roller 182*a* serving as a third roller and a lower roller 182*b* serving as a fourth roller that is fixed to a rotation shaft 182S. An input gear 186 is fixed to the rotation shaft 182S. The input gear 186 is driven by a second registration drive motor 184 via an idler gear 185. The second preregistration roller pair 181 is driven by a second preregistration drive motor 183. Each roller in the second preregistration roller pair 181 and the second registration roller pair 182 rotates about an axis extending in a width direction W.

The rotation shaft 182S supports a rack 191 so that the rack 191 is relatively rotatable and axially immovable with respect to the rotation shaft 182S. The rack 191 receives driving force from a second shift motor 189 via a pinion gear 190, and axially shifts the rotation shaft 182S. The upper roller 182*a* is axially shifted in conjunction with the lower roller 182*b*. Moving the second registration roller pair 182 in the width direction W with the sheet S nipped therebetween moves the sheet S in the width direction W, so that the position of the sheet S in the width direction W is corrected.

The idler gear 185 has a large face width compared with the input gear 186. The reason is to maintain the gears 185 and 186 in mesh with each other and enable rotation of the second registration roller pair 182 even if the second registration roller pair 182 and the input gear 186 are moved in the width direction W.

As with the CIS 34 (see FIG. 2), the second CIS 188 serving as a second detection unit is located off to one side of the center of the conveyance path in the width direction W. To prevent a drop in the detection accuracy of the second CIS 188, the second CIS 188 is located as close to the second registration roller pair 182 as possible.

[Control Blocks]

Figure 12:
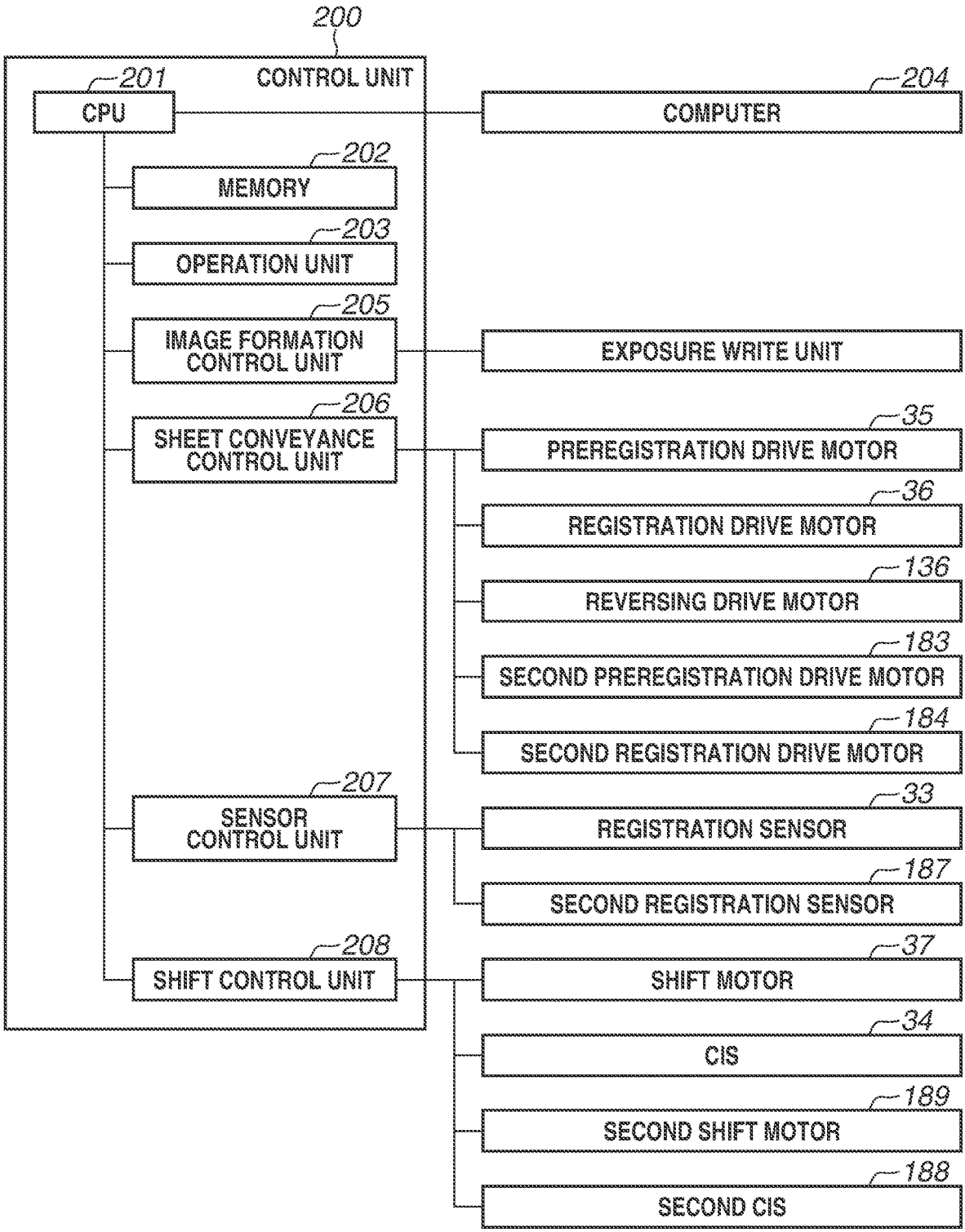
FIG. 12 is a control block diagram illustrating a control unit.

FIG. 12 is a control block diagram illustrating a control unit 200 of an image forming apparatus 1 according to the second exemplary embodiment. A sheet conveyance control unit 206 issues instructions to a preregistration drive motor 35, a registration drive motor 36, a reversing drive motor 136, the second preregistration drive motor 183, and the second registration drive motor 184. Thus, a conveyance operation of the sheet S is controlled. A sensor control unit 207 issues detection start and detection end instructions to a registration sensor 33 and the second registration sensor 187, and receives detection results from the sensors 33 and 187.

A shift control unit 208 receives detection results from the CIS 34 and the second CIS 188, issues driving start and driving end instructions to a shift motor 37 and the second shift motor 189, and controls movement of the sheet S in the width direction W, i.e., a shift operation.

[Skew Correction Operation and Shift Operation by Second Two-Sided Conveyance Unit]

Figure 13:
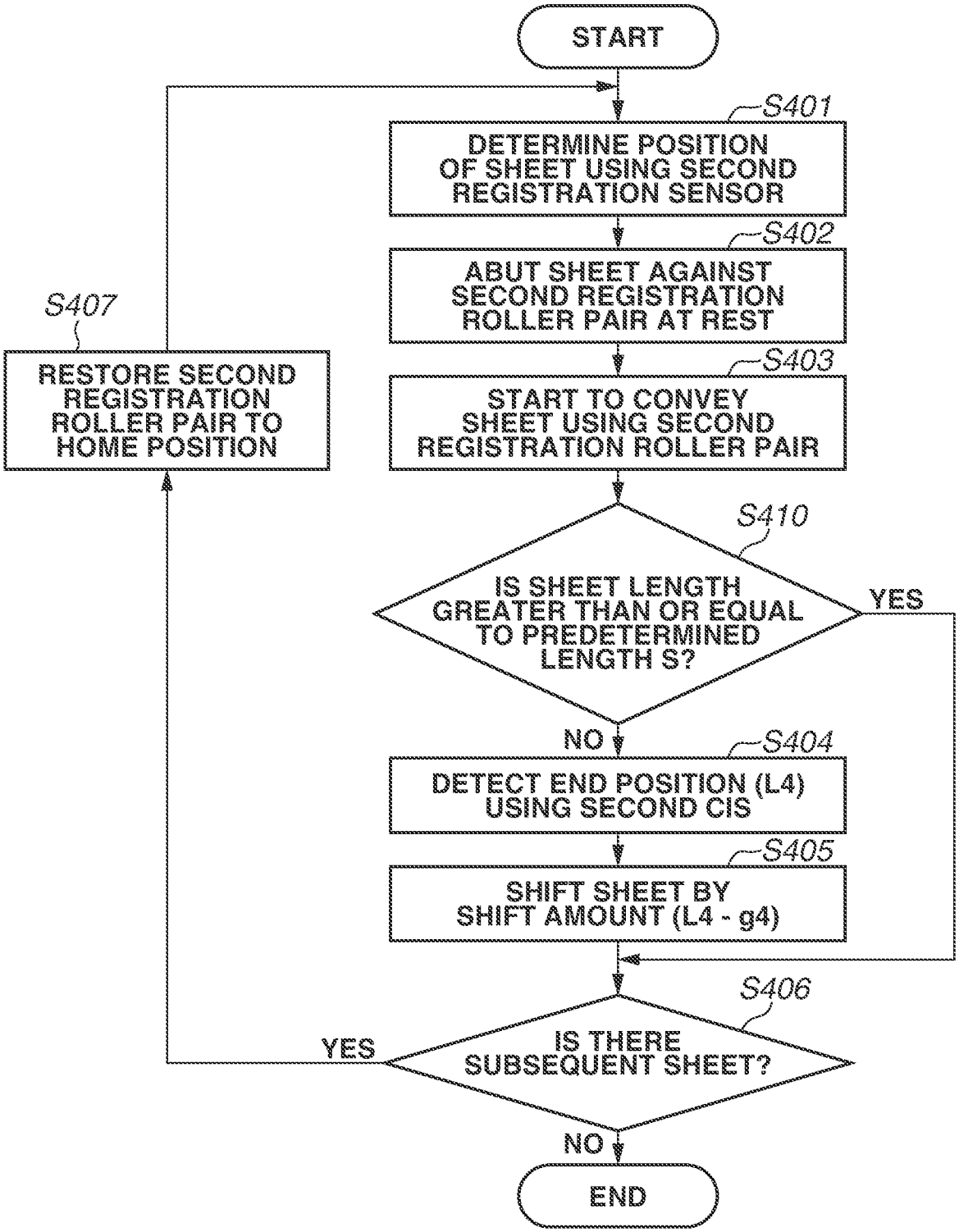
FIG. 13 is a flowchart illustrating a skew correction operation and a shift operation to be performed by the second two-sided conveyance unit.

Next, the skew correction operation (second skew correction operation) and the shift operation by the second two-sided conveyance unit 180 will be described with reference to the flowchart illustrated in FIG. 13. If the print job is a two-sided print job, the sheet S on the first side of which an image has been formed is switched back in the reversing conveyance unit 130. In the present exemplary embodiment, the reversing conveyance unit 130 does not perform a shift operation. The sheet S is then conveyed from the reversing conveyance unit 130 to the two-sided conveyance unit 180. In step S401, the second registration sensor 187 detects the position of the sheet S in the conveyance direction A.

In step S402, the control unit 200 feeds the sheet S by a set feed amount using the second preregistration roller pair 181 based on the result of the detection made by the second registration sensor 187. Thus, the sheet S is abutted against the second registration roller pair 182 at rest and warps by a predetermined amount. The skew of the sheet S is thus corrected. In step S403, the sheet S is nipped and conveyed by the second registration roller pair 182 started to be driven to rotate.

In step S410, the control unit 200 determines whether the length of the sheet S in the conveyance direction A, input to an operation unit 203, is greater than or equal to a length S that is a predetermined length. If the length of the sheet S is determined to not be greater than or equal to the length S (NO in step S410), the processing proceeds to step S404. In step S404, the second CIS 188 detects the end position of the sheet S. The control unit 200 calculates the shift amount of the sheet S based on the result (L4) of the detection and the amount of deviation g4. The amount of deviation g4 refers to the amount by which the sheet S deviates in the width direction W when conveyed from the second two-sided conveyance unit 180 to the registration unit 30. The amount of deviation g4 is obtained in advance in installation of the image forming apparatus 1 or other timings. The shift amount of the sheet S can be determined by subtracting the amount of deviation g4 from the result (L4) of the detection made by the second CIS 188 (L4−g4).

In step S405, the control unit 200 moves the second registration roller pair 182 nipping the sheet S in the width direction W by the shift amount (L4−g4) via the shift control unit 208 and the second shift motor 189 serving as the moving unit. The sheet S can thereby be shifted in the width direction W by the shift amount (L4−g4).

In step S406, the control unit 200 determines whether there is a subsequent sheet. If the control unit 200 determines that there is no subsequent sheet (NO in step S406), the skew correction operation and the shift operation by the second two-sided conveyance unit 180 end. If the control unit 200 determines that there is a subsequent sheet (YES in step S406), the processing proceeds to step S407. In step S407, the control unit 200 restores the second registration roller pair 182 to its home position (center position). The processing then returns to step S401.

In step S410, if the control unit 200 determines that the length of the sheet S is greater than or equal to the predetermined length S (YES in step S410), the processing proceeds to step S406. In other words, if the control unit 200 determines that the length of the sheet S is greater than or equal to the predetermined length S, the second two-sided conveyance unit 180 does not perform a shift operation.

As described above, in the present exemplary embodiment, a two-sided print job involves performing a skew correction operation and a shift operation at each of two locations, the second two-sided conveyance unit 180 and the registration unit 30, after the image formation on the first side of the sheet S. Similar effects to those of the first exemplary embodiment can thus be obtained.

The second two-sided conveyance unit 180 is located near the outlet of the housing 1B to the housing 1A. The amount of skew of the sheet S discharged from the housing 1B and the position of the sheet S in the width direction W can thus be more clearly defined than in the first exemplary embodiment.

OTHER EXEMPLARY EMBODIMENTS

In the first exemplary embodiment, the reversing conveyance unit 130 performs the shift operation, and the second two-sided conveyance unit 150 the skew correction operation. In the second exemplary embodiment, the second two-sided conveyance unit 180 performs both the shift operation and the skew correction operation. However, this is not restrictive. More specifically, at least either one of the shift and skew correction operations can be performed in the reconveyance unit 500. Which of the units performs the shift operation and the skew correction operation is not restrictive. For example, the reversing conveyance unit 130 may perform the skew correction operation and the shift operation. The first two-sided conveyance unit 70 may perform only the shift operation.

In the foregoing exemplary embodiments, as a mode of limiting the shift of the sheet S in the sheet width direction W by the reversing conveyance unit 130 and the second two-sided conveyance unit 150 in a case where the sheet length is greater than or equal to the length S, the sheet S is described to not be shifted at all. However, if the sheet length is greater than or equal to the length S, the amounts by which the reversing conveyance unit 130 and the second two-sided conveyance unit 150 shift the sheet S may be limited to within a predetermined setting amount. More specifically, if the sheet length is less than the length S, the sheet S can be shifted beyond the predetermined setting amount based on the results of the detection made by the CISs without limiting the shift amounts of the sheet S. On the other hand, if the sheet length is greater than or equal to the length S, the shift amounts of the sheet S are limited to not exceed the predetermined setting amount.

In the foregoing exemplary embodiments, the sheet S is shifted in the sheet width direction W using the registration roller pair 32 even if the length of the sheet S in the conveyance direction A is greater than or equal to the length S that is the predetermined length. However, if the length of the sheet S in the conveyance direction A, input to the operation unit 203, is greater than or equal to the length S that is the predetermined length, the shift of the sheet S in the sheet width direction W using the registration roller pair 32 may be restricted.

Examples of other troubles that result from moving a long sheet in the width direction W include a skew of the long sheet due to the shift of the long sheet in the width direction W. The contact area between a long sheet and the conveyance guide is greater than that between a short sheet and the conveyance guide. A long sheet moved in the width direction W is thus likely to be skewed due to a high friction resistance with the conveyance guide.

In the first exemplary embodiment, both the first and second reversing shift roller pairs 132*a* and 132*b* of the reversing shift unit 132 are movable in the width direction W. However, this is not restrictive. For example, either one of the first and second reversing shift roller pairs 132*a* and 132*b* may be movable in the width direction W. The second reversing shift roller pair 132*b* may be omitted, and the first reversing shift roller pair 132*a* may singly nip the sheet S and be moved in the width direction W.

Charge-coupled device (CCD) sensors or complementary metal-oxide-semiconductor (CMOS) sensors may be used instead of the CIS 34, the reversing CIS 139, and the second CIS 188. If the position of the sheet S in the width direction W can be detected using such sensors, the end position of the sheet S in the width direction W does not need to be detected.

Instead of the method for correcting the skew of the sheet S by abutting the sheet S against the registration roller pair 32 or the second registration roller pair 182, a method for abutting the sheet S against a shutter member located upstream of the roller pair in the conveyance direction A may be applied.

While all the foregoing exemplary embodiments have been described by using the electrophotographic image forming apparatus 1, the present disclosure is not limited thereto. For example, an exemplary embodiment of the present disclosure is applicable to an inkjet image forming apparatus that forms an image on a sheet by discharging ink droplets from a nozzle.

An exemplary embodiment of the present disclosure can also be implemented by processing for supplying a program for implementing one or more functions of the foregoing exemplary embodiments to a system or an apparatus via a network or a storage medium, and reading and executing the program by one or more processors in a computer of the system or apparatus. A circuit for implementing one or more functions (such as an application specific integrated circuit [ASIC]) can also be used for implementation.

Embodiments of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described Embodiments and/or that includes one or more circuits (e.g., application specific integrated circuit (ASIC)) for performing the functions of one or more of the above-described Embodiments, and by a method performed by the computer of the system or apparatus by, for example, reading out and executing the computer executable instructions from the storage medium to perform the functions of one or more of the above-described Embodiments and/or controlling the one or more circuits to perform the functions of one or more of the above-described Embodiments. The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc™ (BD)), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-193705, filed Nov. 30, 2021, which is hereby incorporated by reference herein in its entirety.

What is claimed is:

1. An image forming apparatus comprising:

an image forming unit configured to form an image on a sheet;

a reversing roller pair configured to nip the sheet onto which the image forming unit forms the image and to rotate in a first direction, and then rotate in a second direction opposite to the first direction to reverse and convey the sheet;

a moving unit configured to move the reversing roller pair in a width direction of the sheet orthogonal to a conveyance direction of the sheet with the sheet nipped by the reversing roller pair;

an obtaining unit configured to obtain information about a length of the sheet in the conveyance direction; and a control unit configured to control the moving unit based on the information about the length of the sheet obtained by the obtaining unit, wherein, in a case where a first sheet of which the length in the conveyance direction is a first length is reversed and conveyed, the control unit controls the moving unit to move the reversing roller pair conveying the first sheet in the width direction by a first moving amount, and wherein, in a case where a second sheet of which the length in the conveyance direction is a second length greater than the first length is reversed and conveyed, the control unit controls the moving unit to move the reversing roller pair conveying the second sheet in the width direction by a second moving amount smaller than the first moving amount.

2. The image forming apparatus according to claim 1, wherein, in the case where the second sheet is reversed and conveyed, the control unit controls the moving unit so that the moving unit does not move the reversing roller pair conveying the second sheet in the width direction.

3. The image forming apparatus according to claim 1, further comprising a skew correction unit configured to correct skew of the sheet after the sheet is conveyed by the reversing roller pair, wherein the sheet is conveyed toward the image forming unit after the skew of the sheet is corrected by the skew correction unit.

4. The image forming apparatus according to claim 1, further comprising:

a skew correction unit configured to correct skew of the sheet of which the conveyance direction has been reversed by the reversing roller pair; and another moving unit configured to move the sheet of which the skew has been corrected by the skew correction unit in the width direction, wherein, in a case where the first sheet is conveyed, the control unit controls the moving unit to move the reversing roller pair conveying the first sheet in the width direction, the skew correction unit corrects skew of the first sheet, and controls another moving unit to move the first sheet in the width direction in this order after the image forming unit forms a first side image on a first side of the first sheet and before the image forming unit forms a second side image on a second side of the first sheet, and wherein, in a case where the second sheet is conveyed, the skew correction unit corrects skew of the second sheet and another moving unit moves the second sheet in the width direction in this order after the image forming unit forms a first side image on a first side of the second sheet and before the image forming unit forms a second side image on a second side of the second sheet.

5. The image forming apparatus according to claim 1, further comprising a detection unit configured to detect a position of the sheet conveyed by the reversing roller pair in the width direction, wherein the control unit is configured to control the moving unit to move the reversing roller pair in the width direction based on the position of the sheet in the width direction detected by the detection unit.

6. An image forming apparatus comprising:

an image forming unit configured to form an image on a sheet;

a first moving unit located upstream of the image forming unit in a conveyance direction of the sheet and configured to move the sheet in a width direction orthogonal to the conveyance direction by moving in the width direction while nipping the sheet;

a reconveyance unit configured to reverse the sheet on a first side of which an image has been formed by the image forming unit front and back and convey the sheet to the image forming unit again, wherein the reconveyance unit includes a second moving unit configured to move the sheet in the width direction by moving in the width direction while nipping the sheet;

an obtaining unit configured to obtain information about a length of the sheet in the conveyance direction; and a control unit configured to control the second moving unit based on the information about the length of the sheet obtained by the obtaining unit, wherein, in a case where a first sheet of which the length is a first length is conveyed, the control unit controls the second moving unit to move the first sheet in the width direction, and wherein, in a case where a second sheet of which the length is a second length greater than the first length is conveyed, the control unit controls the second moving unit not to move the second sheet in the width direction.

7. The image forming apparatus according to claim 6, wherein the control unit is configured to control the first and second moving units so that, in a case where the first sheet is conveyed, the first moving unit moves the first sheet in the width direction and the second moving unit moves the first sheet in the width direction, and in a case where the second sheet is conveyed, the first moving unit moves the second sheet in the width direction and the second moving unit does not move the second sheet in the width direction.

8. The image forming apparatus according to claim 6, wherein the reconveyance unit includes a reversing unit configured to convey the sheet in a first direction and then in a second direction opposite to the first direction, and a two-sided conveyance unit configured to convey the sheet conveyed by the reversing unit toward the image forming unit, and wherein the second moving unit is included in the reversing unit.

9. The image forming apparatus according to claim 6, further comprising:

a first detection unit configured to detect a position of the sheet in the width direction; and a second detection unit configured to detect a position of the sheet in the width direction, wherein the first moving unit is configured to move the sheet in the width direction based on a result of detection made by the first detection unit, and wherein the second moving unit is configured to move the sheet in the width direction based on a result of detection made by the second detection unit.

10. The image forming apparatus according to claim 6, wherein the reconveyance unit is configured to perform a skew correction operation for correcting skew of the sheet by abutting a leading edge of the sheet, and wherein, in a case where the sheet has the first length or the second length, the reconveyance unit performs the skew correction operation.

11. An image forming apparatus comprising:

an image forming unit configured to form an image on a sheet;

a reversing roller pair configured to nip the sheet onto which the image forming unit forms the image and to rotate in a first direction, and then rotate in a second direction opposite to the first direction to reverse and convey the sheet;

a moving unit configured to move the reversing roller pair in a width direction of the sheet orthogonal to a conveyance direction of the sheet with the sheet nipped by the reversing roller pair;

an obtaining unit configured to obtain information about a length of the sheet in the conveyance direction; and a control unit configured to control the moving unit based on the information about the length of the sheet obtained by the obtaining unit, wherein, in a case where a first sheet of which the length in the conveyance direction is a first length is reversed and conveyed, the control unit controls the moving unit to move the reversing roller pair conveying the first sheet in the width direction, and wherein, in a case where a second sheet of which the length in the conveyance direction is a second length greater than the first length is reversed and conveyed, the control unit controls the moving unit to restrict movement of the reversing roller pair conveying the second sheet in the width direction.

12. The image forming apparatus according to claim 11, wherein, in the case where the second sheet is reversed and conveyed, the control unit controls the moving unit so that the moving unit does not move the reversing roller pair conveying the second sheet in the width direction.

13. The image forming apparatus according to claim 11, wherein, in the case where the second sheet is reversed and conveyed, the control unit controls to limit a moving amount of the reversing roller pair conveying the second sheet by the moving unit in the width direction to not exceed a predetermined amount, and wherein, in the case where the first sheet is reversed and conveyed, the control unit controls to allow the moving unit to move the reversing roller pair conveying the first sheet in the width direction beyond the predetermined amount.

* * * * *